US012091922B2

(12) United States Patent
Montoya et al.

(10) Patent No.: US 12,091,922 B2
(45) Date of Patent: Sep. 17, 2024

(54) ARTIFICIAL LIFT SYSTEMS UTILIZING HIGH SPEED CENTRALIZERS

(71) Applicant: Chevron U.S.A. Inc., San Ramon, CA (US)

(72) Inventors: James Daniel Montoya, Santa Fe, NM (US); Jose Alberto Gamboa, Houston, TX (US); Matthew John Bower, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 167 days.

(21) Appl. No.: 17/631,832

(22) PCT Filed: Jul. 30, 2020

(86) PCT No.: PCT/US2020/044353
§ 371 (c)(1),
(2) Date: Jan. 31, 2022

(87) PCT Pub. No.: WO2021/022093
PCT Pub. Date: Feb. 4, 2021

(65) Prior Publication Data

US 2022/0275691 A1 Sep. 1, 2022

Related U.S. Application Data

(60) Provisional application No. 63/051,716, filed on Jul. 14, 2020, provisional application No. 62/881,469, filed on Aug. 1, 2019.

(51) Int. Cl.
*E21B 17/10* (2006.01)

(52) U.S. Cl.
CPC ..... *E21B 17/1021* (2013.01); *E21B 17/1028* (2013.01); *E21B 17/1057* (2013.01)

(58) Field of Classification Search
CPC ..... E21B 43/126; E21B 43/128; E21B 1/02; E21B 3/02
See application file for complete search history.

(56) References Cited

U.S. PATENT DOCUMENTS 1,893,020 A 1/1933 Cushing
1,898,074 A 2/1933 Bailey
(Continued)

FOREIGN PATENT DOCUMENTS

GB 1110840 A 4/1968

OTHER PUBLICATIONS

PCT International Search Report and Written Opinion, mailed on Oct. 22, 2020, issued in International Application No. PCT/US2020/044351, filed on Jul. 30, 2020, 9 pages.
(Continued)

*Primary Examiner* — Nicole Coy
*Assistant Examiner* — Yanick A Akaragwe
(74) *Attorney, Agent, or Firm* — Smith & Woldesenbet Law Group, PLLC

(57) ABSTRACT

An artificial lift system utilizing a downhole impeller-style pump and a motor at the surface. The system includes a centralizer for use with the rod string or tubing. The centralizer centralizes a rotating rod at intermediate points within the tubing string. The centralizer includes a plurality of flexure springs and bearings. A rod string tensioner induces a tension load on the rod string.

18 Claims, 15 Drawing Sheets

(56) References Cited

U.S. PATENT DOCUMENTS

| | | | | |
|---|---|---|---|---|
| 2,228,648 | A * | 1/1941 | Welles | E21B 17/1028 82/170 |
| 2,251,040 | A | 7/1941 | Dewees | |
| 4,606,417 | A | 8/1986 | Webb | |
| 4,747,452 | A * | 5/1988 | Clark | E21B 37/02 166/241.1 |
| 4,787,458 | A | 11/1988 | Langer | |
| 5,261,488 | A | 11/1993 | Gullet | |
| 5,447,200 | A | 9/1995 | Dedora | |
| 5,573,063 | A * | 11/1996 | Morrow | F16H 1/20 417/423.6 |
| 5,575,333 | A | 11/1996 | Lirette | |
| 5,727,627 | A | 3/1998 | Squires | |
| 5,806,591 | A | 9/1998 | Sable | |
| 5,810,100 | A | 9/1998 | Samford | |
| 6,382,333 | B1 | 5/2002 | Murray | |
| 7,140,432 | B2 | 11/2006 | Gremillion | |
| 8,336,632 | B2 | 12/2012 | Morrow | |
| 10,167,682 | B2 | 1/2019 | Morrow | |
| 2006/0266064 | A1* | 11/2006 | Rowatt | E21B 47/0175 62/6 |
| 2009/0223665 | A1 | 9/2009 | Colley, III | |
| 2011/0048738 | A1* | 3/2011 | Morrow | F04D 13/10 166/380 |
| 2012/0061099 | A1 | 3/2012 | Wold | |
| 2012/0168149 | A1 | 7/2012 | Kaltwasser | |
| 2012/0237380 | A1* | 9/2012 | Robles-Villa | F04C 13/008 418/48 |
| 2014/0262259 | A1* | 9/2014 | Fouillard | E21B 43/126 166/272.3 |
| 2015/0167686 | A1 | 6/2015 | Baillargeon | |
| 2016/0265325 | A1 | 9/2016 | Sharma | |
| 2017/0016311 | A1 | 1/2017 | Fernandez Restrepo | |
| 2017/0244312 | A1* | 8/2017 | Normann | H02K 47/20 |
| 2018/0275686 | A1 | 9/2018 | Shariff | |
| 2020/0190916 | A1 | 6/2020 | Morrow | |

OTHER PUBLICATIONS

PCT International Search Report and Written Opinion, mailed on Nov. 5, 2020, issued in International Application No. PCT/US2020/044353, filed on Jul. 30, 2020, 11 pages.

* cited by examiner

ARTIFICIAL LIFT SYSTEMS UTILIZING HIGH SPEED CENTRALIZERS

CROSS REFERENCE TO RELATED APPLICATIONS

The present application claims priority under 35 U.S.C. Section 119(e) to U.S. Provisional Patent Application No. 62/881,469, filed Aug. 1, 2019 and titled "High Speed Rotor Dynamics Centralizer," and to U.S. Provisional Patent Application No. 63/051,716, filed Jul. 14, 2020 and titled "Artificial Lift Systems Utilizing High Speed Centralizers," The entire contents of the foregoing applications are hereby incorporated herein by reference.

TECHNICAL FIELD

The present application is directed to artificial lift systems utilizing a centralizer designed for high speed rotor dynamics applications.

BACKGROUND

Sucker rod centralizers are typically utilized in artificial lift reciprocating applications, such as pump-jacks and low speed (200-400 rpm) rotary applications, such as in progressive cavity pumping (PCP) systems. Direct drive pumps (DDP) and geared centrifugal pumps (GCP) are two artificial lift systems that could potentially enhance oil and gas recovery in downhole applications. However, conventional rod centralizer technology (i.e. non-rotating and spin-through technology) may not be suitable for use in high speed rotary applications, such as DDP, as they are not designed to handle the rotor dynamics encountered in high speed shaft rotations and tend to fail as a result of the vibration phenomena encountered at high rotational velocities.

Accordingly, there is a need for an artificial lift system having a centralizer that can be utilized at coupling points of a drive-rod component at high angular velocities (greater than 1000 rpm) and capable to operate at depths greater than 1,000 ft.

SUMMARY

The present application is generally related to artificial lift systems utilizing centralizers for use within long spanning cylindrical tube or pipe in high speed rotor dynamics applications. In one aspect, an artificial lift system for wellbore applications includes a motor and a drive selected from the group consisting of: geared centrifugal head drives and direct head drives. The motor and the drive are positioned above a ground surface of a wellbore. The system further includes a rod string positioned within a cylindrical tube in the wellbore, at least one centralizer for centralizing the rod within the cylindrical tube, and a downhole impeller-style pump coupled to a lowermost section of the rod. At least a portion of the rod string has an induced tension load.

In another aspect, a method of operating an artificial lift system for wellbore applications includes a variable speed device relaying a command to a drive and motor assembly, the drive and motor assembly operating a rod string tensioner to induce a tension load on the rod string, the drive and motor assembly rotating the rod string positioned within a cylindrical tube in the wellbore at a first target speed, at least one centralizer centralizing the rod string within the cylindrical tube, and the rotating rod string operating a downhole impeller-style pump coupled to a lowermost section of the rod string. In some embodiments, a downhole transmission rotates the rod string at a second target speed. In some embodiments, a cooling system dissipates heat produced by the drive and motor assembly.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
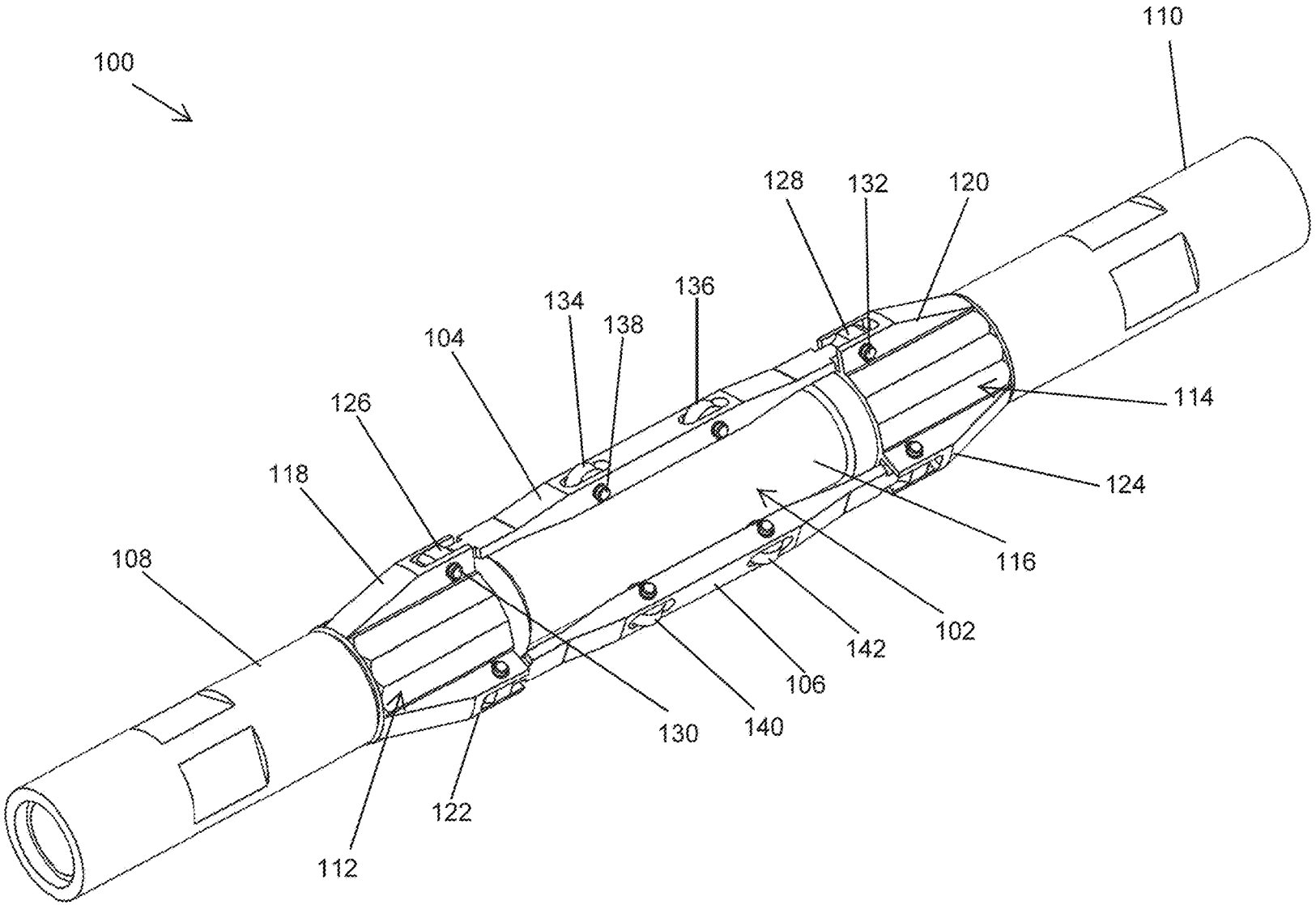
FIG. 1 illustrates perspective view of a high speed rotor dynamics centralizer according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings may designate like or corresponding but not necessarily identical elements.

DETAILED DESCRIPTION

In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

The present application is generally related to centralizers and more particularly to a centralizer for use within a cylindrical tube or pipe in high speed rotor dynamics applications. The present application is also directed to artificial lift systems utilizing a centralizer to centralize a rotating drive-rod, or rod string, or "rotor" at coupling points within a cylindrical tube, such as tubing string, of an oilfield wellbore. This system has use in any application in which reliable operation of a downhole electrical motor is desired, including heavy oil, low productivity wells and enhanced oil recovery. In certain embodiments, the systems of the present invention may be utilized in high temperature (above 400 F) applications, as it facilitates steam injection of the well with artificial lift in place, and addresses high-temperature reliability issues, as motors can be located at surface with a downhole pump (centrifugal or impeller-style) driven by the rotating drive-rod.

FIG. 1 illustrates a perspective view of a high speed rotor dynamics centralizer 100 according to an example embodiment. In some example embodiments, the centralizer 100 includes a cylindrical housing 102 and multiple flexure springs (e.g., three flexure springs) including flexure springs 104, 106. The centralizer 100 may also include couplers 108, 110 that are attached to the housing 102 at opposite ends of the housing 102. The housing 102 may include end portions 112, 114 and a middle portion that is between the end portions 112, 114. The flexure spring 104 is attached to the end portions 112, 114. For example, the centralizer 100 may include a mounting structure 118 at the end portion 112 and another mounting structure 120 at the end portion 114, where the mounting structures 118, 120 are used to attach the flexure spring 104 to the housing 102. The flexure spring 106 is attached to the housing 102 using an attachment structure 122 at the end portion 112 and an attachment structure 124 at the end portion 114. A third flexure spring (shown in FIG. 3) may be similarly attached to the end portions 112, 114 using respective attachment structures.

In some example embodiments, each flexure spring of the centralizer 100 may include a spring element that includes attachment end portions that are attached to respective mounting structures of the housing 102. For example, the flexure spring 104 extends between the end portions 112, 114 spaced from a middle portion 116 of the housing 102 that is between the end portions 112, 114. To illustrate, the flexure spring 104 may include an attachment end portion 126 that is attached to the mounting structure 118 using, for example, a clevis pin 130. The flexure spring 104 may also include an attachment end portion 128 at an opposite end of the flexure spring 104 that is attached to the mounting structure 120 using, for example, a clevis pin 132. The flexure spring 106 and the third flexure spring may be similarly attached to mounting structures at the end portions 112, 114 using clevis pins and may extend between the end portions 112, 114 spaced from the middle portion 116 of the housing 102 in a similar manner as the flexure spring 104.

In some example embodiments, two roller wheels may be attached to each flexure spring of the centralizer 100. For example, roller wheels 134, 136 may be attached to the flexure spring 104 and may be oriented to facilitate the movement/insertion of the centralizer 100 in longitudinal directions through a tubing and to resist the rotation of the housing 102 of the centralizer 100 in the tubing. The roller wheels 134, 136 may be rotatably attached to the flexure spring 104 using, for example, a respective clevis wheel such as a clevis pin 138. When the centralizer 100 is positioned in a tubing, the wheels 134, 136 may be in contact with the inner surface of the tubing such that the flexure spring 104 is compressed toward the middle portion 116 of the housing 102, and applies a preload that is intended to rotationally fix or couple the centralizer to the tubing. The roller wheels 134, 136 may be attached to the flexure spring 104 such that the wheels 134, 136 extend radially beyond the flexure spring 104 with respect to a center axis through of the cylindrical housing 102.

In some example embodiments, roller wheels 140, 142 may be similarly attached to the flexure spring 106 using respective clevis pins. The roller wheels 140, 142 may also radially extend beyond the flexure spring 106 in a similar manner as described with respect to the wheels 134, 136. Another pair of roller wheels may also be attached to the third flexure spring of the centralizer 100 and may radially extend beyond the third flexure spring.

In some example embodiments, the centralizer 100 may be mounted to rods using the couplers 108, 110. For example, each coupler 108, 110 may be threaded to receive a threaded end of a respective rod. As explained below with respect to FIG. 2, the couplers 108, 110 may be attached to a shaft that extends through a cavity of the housing 102 such that the shaft and the couplers 108, 110 can rotate while the housing 102 along with flexure springs remain rotationally static inside a tubing. In some alternative embodiments, other coupling structures other than the couplers 108, 110 may be used to attach the centralizer 100 to a rod string as can be readily understood by those of ordinary skill in the art with the benefit of this disclosure.

During operations, the centralizer 100 may be placed in a tubing such that the roller wheels attached to the flexure springs come in contact with the tubing and the flexure springs are compressed by the tubing toward the middle portion 116 of the housing 102. Because of the orientations of the flexure springs, including the flexure springs 104, 106, the housing 102 of the centralizer 100 along flexure springs may remain rotationally static while the centralizer 100 moves through the tubing and/or the couplers 108, 110 along with respective attached rods rotate.

By using the roller wheels that are attached to the flexure springs, the centralizer 100 facilitates the longitudinal movement of the centralizer 100 in a tubing while restraining the rotation of the centralizer 100 in the tubing by virtue of counteracting force exerted by the compressed flexure springs. In contrast to centralizers that use fixed and rigid vanes to provide lateral restraints, the use of the roller wheels attached to the flexure springs enables the centralizer 100 to be moved through a tubing with relatively reduced risk of getting stuck, for example, at tubing joints while enabling the relatively high speed rotation of rods attached to the couplers 108, 110. Further, by providing an open space (i.e., no vanes) between adjacent flexure springs, fluid may flow pass on the outside of the centralizer 100 with relatively less obstruction compared to centralizers that have fixed vanes.

In some example embodiments, the housing 102 may be made from aluminum or another suitable material using methods known by those of ordinary skill in the art with the benefit of this disclosure. In some example embodiments, the flexure springs 104, 106, etc. and the couplers 108, 110 may be made from steel or another suitable material using methods known to those of ordinary skill in the art with the benefit of this disclosure. In some example embodiments, the roller wheels may be made from aluminum or another suitable material using methods known by those of ordinary skill in the art with the benefit of this disclosure.

In some example embodiments, the flexure springs can have a coil, compression, extension, or torsional configuration without departing from the scope of this disclosure. In some example embodiments, the flexure springs may each be a leaf spring or another type of spring. In some alternative embodiments, more or fewer than two roller wheels can be attached to each flexure spring without departing from the scope of this disclosure. In some example embodiments, the centralizer 100 may include more than three flexure springs and more than three corresponding pairs of mounting structures without departing from the scope of this disclosure. In some alternative embodiments, other attachment elements instead of or in addition due clevis pins may be used to attach the flexure springs to the housing 102 and to attach the roller wheels to the flexure springs. In some alternative embodiments, the flexure springs 104, 106, etc. may be attached to the end portions 112, 114 using structures other than the mounting structures, such as the mounting structures 118, 120, 122, 124, etc.

Figure 2:
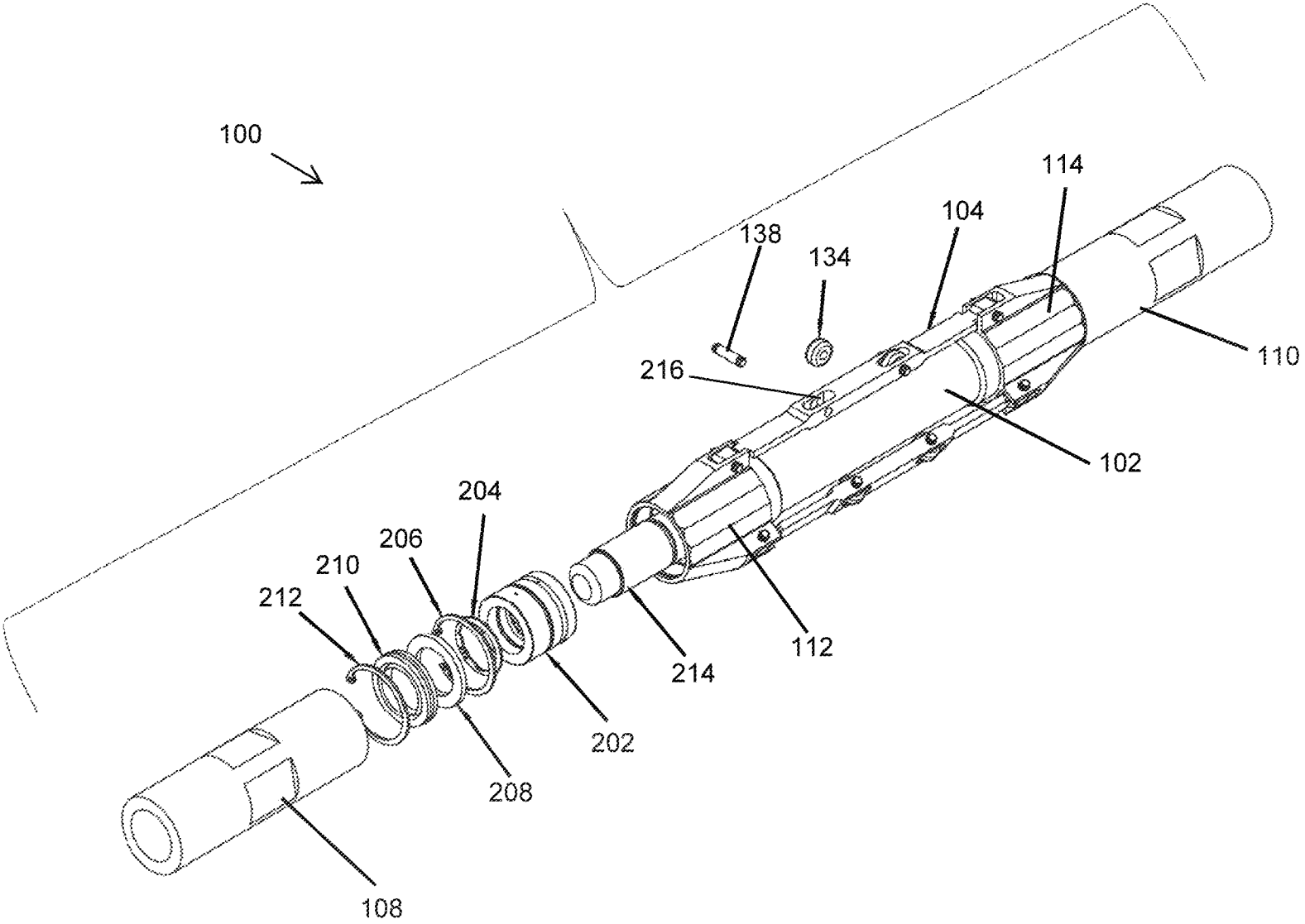
FIG. 2 illustrates a partially exploded view of the high speed rotor dynamics centralizer of FIG. 1 according to an example embodiment.

FIG. 2 illustrates a partially exploded view of the high speed rotor dynamics centralizer 100 of FIG. 1 according to an example embodiment. Referring to FIGS. 1 and 2, in some example embodiments, the centralizer 100 includes a shaft 214 that extends through a cavity of the housing 102 of the centralizer 100. Each end portion of the shaft 214 may be attached to the respective one of the couplers 108 or 110. As described above, each end portion of the shaft 214 may be threaded and may be attached to a threaded hole of the respective coupler 108 or 110. The shaft 214 may be coupled to the couplers 108, 110 and extend through the cavity of the housing 102 such that the shaft 214 rotates along with the couplers 108, 110 relative to the housing 102.

In some example embodiments, the centralizer 100 may include a bearing 202 at each end portion 112, 114, where each end portion of the shaft 214 extends through the respective bearing 202.

In some example embodiments, the centralizer 100 may also include a retaining ring 204 to retain the respective bearing 202 at each end portion 112, 114 of the housing 102. The centralizer 100 may also include a retaining ring 206, a seal backing ring 208, a shaft seal 210, and another retaining ring 212 at each end portion 112, 114. Each retaining ring 204, 206, 212 may be at least partially positioned around a respective end portion of the shaft 214. Each seal backing ring 208 and each shaft seal 210 may be positioned around a respective end portion of the shaft 214. The cavity of the housing 102 may be hermetically sealed by the shaft seal 210 at the end portions 112, 114. The sealed cavity of the housing 102 may serve as a reservoir for containing a lubricant to lubricate the bearing 202 at each end portion 112, 114, which can result in reduced friction and heat and prolong the life of the components of the centralizer 100.

Figure 5:
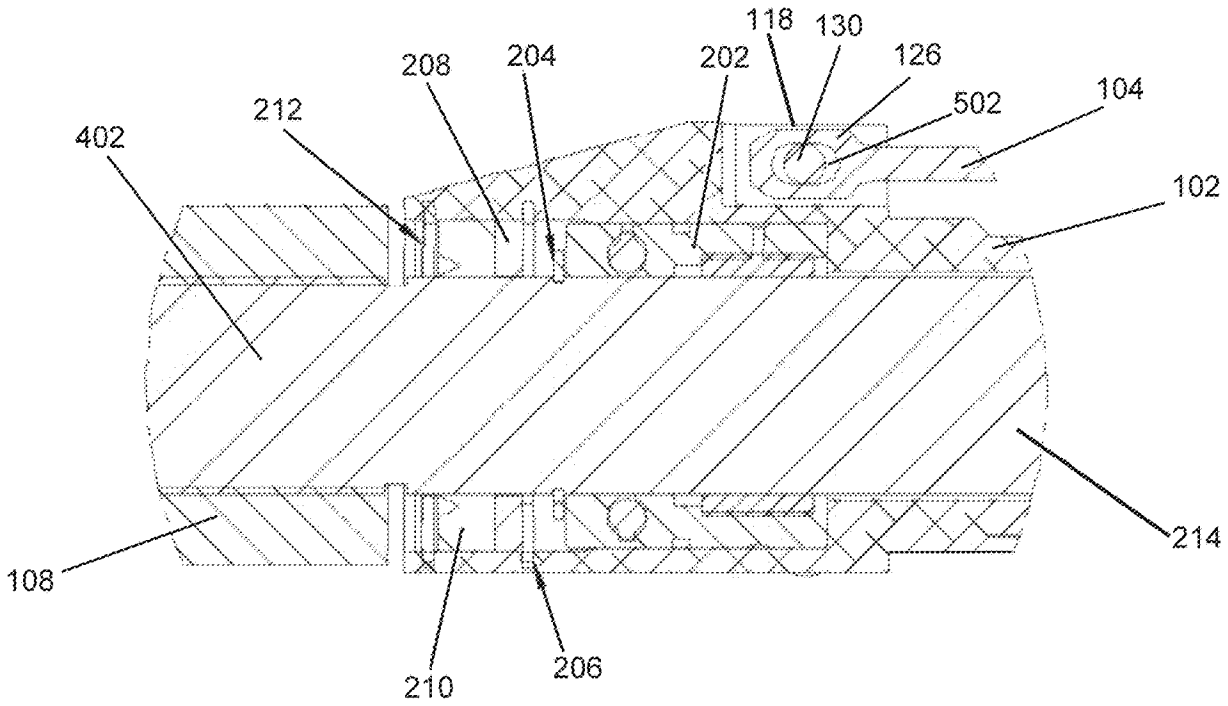
FIG. 5 illustrates a close-up view of a portion B of the high speed rotor dynamics centralizer shown in FIG. 4 according to an example embodiment.

In some example embodiments, each retaining ring 204 retains the respective bearing 202 in place around the shaft 214 at the respective end portion 112, 114 of the housing 102. For example, the retaining ring 204 may be positioned in an annular groove formed in the shaft 214 as shown in FIG. 5. The retaining rings 206, 212 at each end portion of the housing 102 retain the seal backing ring 208 and the seal 210 in place. For example, the retaining rings 206, 212 may be positioned in a respective groove formed in the housing 102 as shown in FIG. 5. The bearings 202 allow the shaft 214 to rotate along with the couplers 108, 110 relative to the housing 102 that can remain rotationally static.

As more clearly shown in FIG. 2, in some example embodiments, the flexure spring 104 includes a slot 216 for positioning the roller wheel 134. The clevis pin 138 may be inserted through respective holes in the roller wheel 134 and the flexure spring 104 to rotatably attach the roller wheel 135 to the flexure spring 134. The other roller wheels used in the centralizer 100 may be rotatably attached to the respective flexure springs in a similar manner.

In general, the bearing 202 may be or may be replaced with a roller bearing, a thrust bearing, a journal bearing, or generally a type including high temperature graphite, ceramic, polycrystalline diamond, tungsten carbide, and magnetic bearing types. In some example embodiments, a polycrystalline diamond bearing may be used in place of the bearing 202, where each bearing at the end portions 112, 114 is unsealed such that fluid freely flows through the bearing interfaces and enabling generated frictional heat to be transferred to the fluid. In some alternative embodiments, the centralizer 100 may include different components and/or a different arrangements of the components than shown in FIG. 2 without departing from the scope of this disclosure. In some alternative embodiments, some of the components of the centralizer 100 may be omitted or integrated into a single component without departing from the scope of this disclosure.

Figure 3:
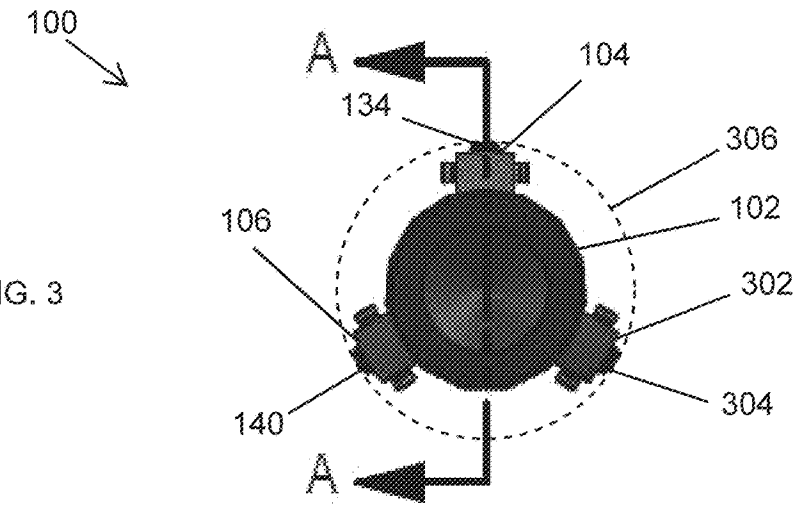
FIG. 3 illustrates an end-side view of the high speed rotor dynamics centralizer of FIG. 1 according to an example embodiment.

FIG. 3 illustrates an end-side view of the high speed rotor dynamics centralizer 100 of FIG. 1 according to an example embodiment. Referring to FIGS. 1-3, in some example embodiments, the centralizer 100 includes the flexure springs 104, 106, and a flexure spring 302 that is similar to the flexure springs 104, 106. The flexure springs 104, 106, 302 may be spaced 120 degrees from each other around the housing 102. Two roller wheels including a roller wheel 304 may be attached to the flexure spring 304 in a similar manner as described with respect to the flexure springs 104, 106.

As shown in FIG. 3, an illustrative circle 306 represents a circle through the farthest end points of circularly aligned wheels of the centralizer 100, such as the wheels 134, 140, 304 attached to the flexure springs 104, 106, 302, with respect to an axis through the center of the housing 102. In some example embodiments, the centralizer 100 may be used in a tubing that has an inner diameter that is less than the diameter of the illustrative circle 306. To illustrate, when the diameter of the illustrative circle 306 is smaller than the diameter of a tubing, inserting the centralizer 100 into the tubing can result in the compression of the flexure springs 104, 106, 302 toward the middle portion 116 of the housing 102. Because of the orientations of the wheels 134, 140, 304, the centralizer 100 along with an attached rod or rod string can be readily moved further into or out of the tubing while the counter force exerted by the flexure springs 104, 106, 302 can restrain the housing 102 along with the flexure springs 104, 106, 302 from rotating. The flexure springs 104, 106, 302 retain the rod or rod string attached to the centralizer 100 centered in the tubing.

Figure 4:
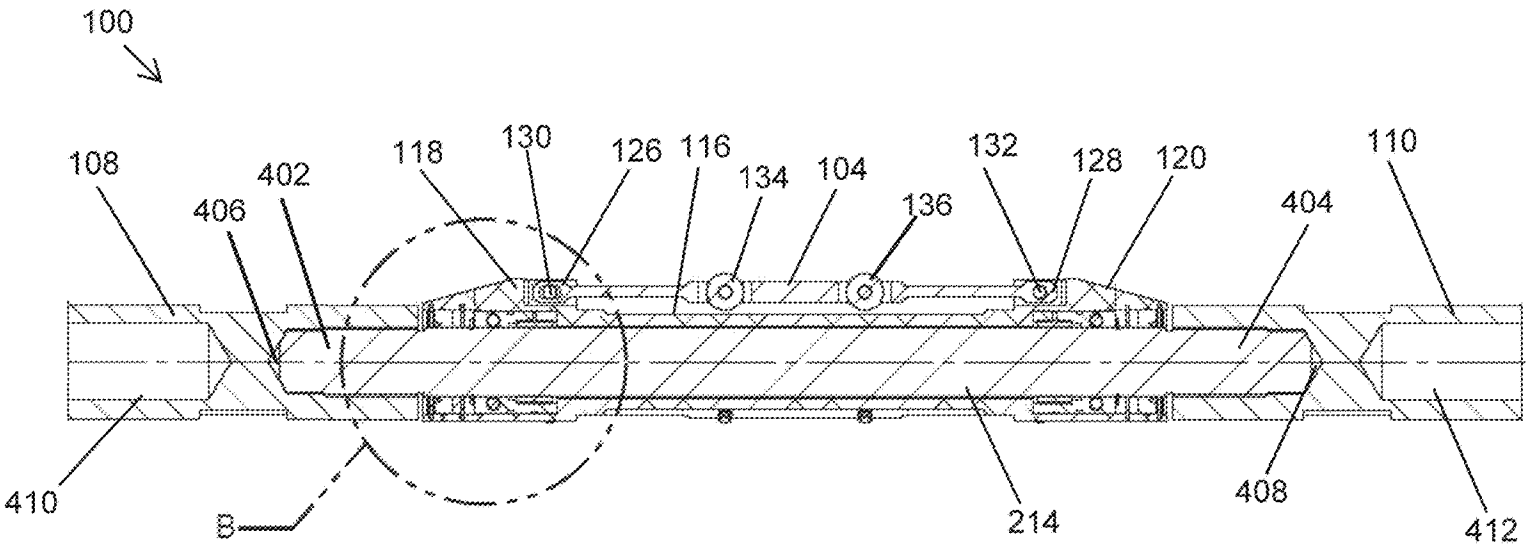
FIG. 4 illustrates a cross-sectional view of the high speed rotor dynamics centralizer of FIG. 1 along line A-A according to an example embodiment.

FIG. 4 illustrates a cross-sectional view of the high speed rotor dynamics centralizer 100 of FIG. 1 along line A-A according to an example embodiment. Referring to FIGS. 1-4, in some example embodiments, the shaft 214 is attached to couplers 108, 110 at opposite end portions of the shaft 214. To illustrate, a threaded end portion 402 of the shaft 214 may be positioned in a threaded hole 406 of the coupler 108, and a threaded end portion 404 of the shaft 214 may be positioned in a threaded hole 408 of the coupler 110. The coupler 108 may also have another threaded hole 410 for attaching a rod (e.g., a threaded-end rod) to the coupler 108, and thus to the centralizer 100. The coupler 110 may also have another threaded hole 412 for attaching a rod (e.g., a threaded-end rod) to the coupler 110, and thus to the centralizer 100.

As shown in FIG. 4, the end portion 126 of the flexure spring 104 is attached to mounting structure 118 using the clevis pin 130, and the end portion 128 of the flexure spring 104 is attached to the mounting structure 120 using the clevis pin 132. As shown in FIG. 4, the roller wheels 134, 136 extend beyond the flexure spring 104 such that the roller wheels 134, 136, and not the flexure spring 104, make contact with the inner surface of a tubing in which the centralizer 100 is placed. As more clearly shown in FIG. 4, the flexure spring 304 as well as the roller wheels 134, 136 are spaced from the middle portion 116 of the housing 102 when the flexure spring 104 is uncompressed. When the flexure spring 104 is compressed, for example, as result of the roller wheels 134, 136 being in contact with and preloaded at the inner surface of a tubing, the flexure spring 304 as well as the roller wheels 134, 136 may become closer to but still spaced from the middle portion 116 of the housing 102 to allow wheel movement/rotation. The other flexure springs and roller wheels of the centralizer 100 may operate in a similar manner to center rod(s) or rod strings(s) attached to the centralizer 100.

FIG. 5 illustrates a close-up view of a portion B of the high speed rotor dynamics centralizer 100 as shown in FIG. 4 according to an example embodiment. Referring to FIGS. 1-5, in some example embodiments, the threaded end portion 402 of the shaft 214 is attached to the threaded hole of the coupler 108. The retaining ring 204 is positioned in a groove of the shaft 214 to retain the bearing 202 in place around the shaft 214 at the end portion 112 of the housing 102. The bearing 202 is retained in place by the housing 102 at an opposite end from the retaining ring 204. The retaining rings 206, 212 retain the seal backing ring 208 and the seal 210 in place and are positioned in respective grooves in the housing 102. As described above, bearing 202 allows the shaft 214 to rotate along with the coupler 108 relative to the housing 102. In some example embodiments, the shaft 214 is attached to coupler 110 in a similar manner. In some example embodiments, the bearing 202 and other components at the end portion 114 of the housing 102 may be attached and arrange in a similar manner.

In some example embodiments, the clevis pin 130 extends through an elongated attachment hole 502 at the end portion 126 of the flexure spring 126. For example, the clevis pin 130 may extend through the attachment hole 502 as well as through holes in the mounting structure 118 at the end portion 112 of the housing 102.

Figure 6:
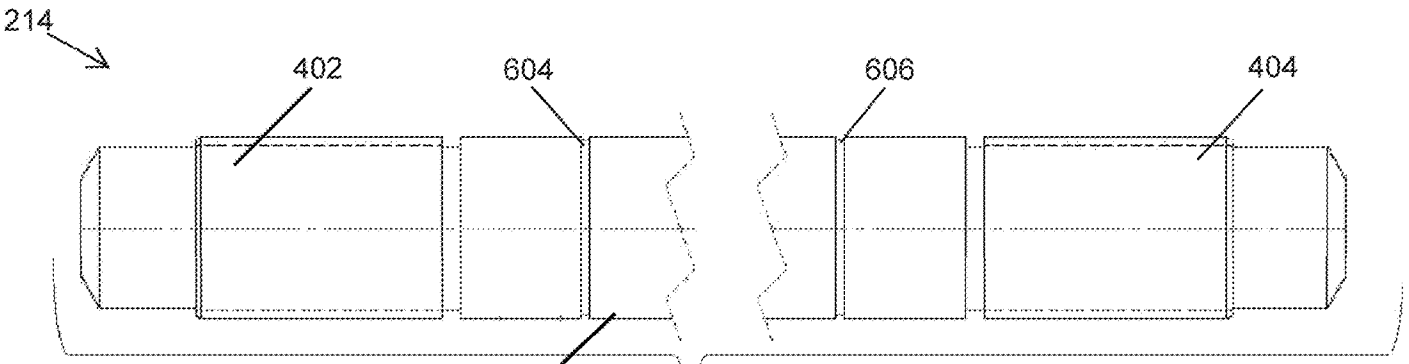
FIG. 6 illustrates a shaft of the high speed rotor dynamics centralizer of FIG. 1 according to an example embodiment.

FIG. 6 illustrates the shaft 214 of the high speed rotor dynamics centralizer 100 of FIG. 1 according to an example embodiment. Referring to FIGS. 1-6, in some example embodiments, the shaft 214 may include the end portions 402, 404, and a middle portion 602 that is between the end portions 402, 404. At least some portions of the end portions 402, 404 may be threaded for attachment to a threaded coupler such as the couplers 108, 110. The shaft 214 may include a groove 604 for attaching the retainer 204 to the shaft 214 to retain the bearing 202 in place at the end portion 112 of the housing 102. The shaft 214 may also include a groove 606 for attaching the retainer 204 to the shaft 214 to retain the bearing 202 in place at the end portion 114 of the housing 102.

In some example embodiments, the shaft 214 may be made from aluminum or another suitable material using methods known by those of ordinary skill in the art with the benefit of this disclosure. For example, the shaft 214 may be made using milling and/or other methods. In some alternative embodiments, the shaft 214 may have a different shape than shown without departing from the scope of this disclosure.

Figure 7:
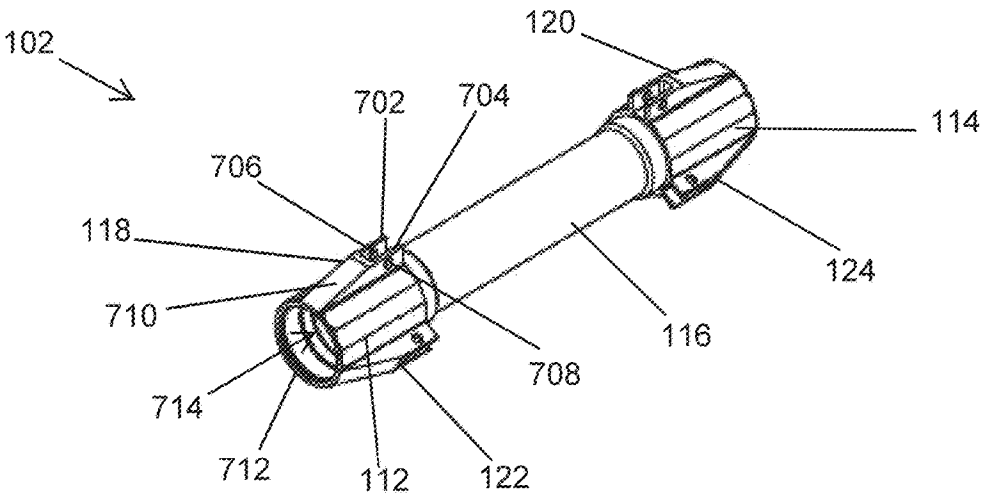
FIG. 7 illustrates a housing of the high speed rotor dynamics centralizer of FIG. 1 according to an example embodiment.

FIG. 7 illustrates the housing 102 of the high speed rotor dynamics centralizer of FIG. 1 according to an example embodiment. Referring to FIGS. 1-7, in some example embodiments, the housing 102 includes the end portions 112, 114 and the middle portion 116 that is between the end portions 112, 114. As described above, the flexure springs 104, 106, 302 may be attached to mounting structures, such as the mounting structures 118-124. To illustrate, in some example embodiments, the mounting structure 118 includes frames 702, 704 spaced from each other such that the attachment end portion 126 can be positioned between the frames 702, 704. The frame 702 may include an attachment hole 706, and the frame 704 may include an attachment hole 708. The clevis pin 130 or another attachment element may extend through the holes 706, 708 as well as the attachment hole 504 to attach the flexure spring 104 to the mounting structure 118. The mounting structure 118 may also include a ramp portion 710 coupled to the frames 702, 704.

In some example embodiments, the ramp portion 710 may be slated to facilitate the flow of fluid around the housing 102. The other mounting structures of the housing 102, such as the mounting structures 120-124, are substantially similar to the mounting structure 118.

In some example embodiments, the mounting structures at each end portion 112, 114 are spaced 120 degrees around the housing 102 when the centralizer 100 includes three mounting flexure springs. In general, the mounting structures are spaced equally around the housing 102. The spaces between adjacent mounting structures at the same end portion 112 or 114 of the housing 102 generally left unoccupied to facilitate the flow of fluid around the housing 102.

In some example embodiments, the shaft 214 extends through the cavity 714 of the housing 102 extend beyond the openings of the housing 102 at the end portions 112, 114 of the housing 102. For example, the end portion 402 of the shaft 214 shown more clearly in FIG. 4 may extend beyond the opening 712 of the housing 102 at the end portion 112 of the housing 102. The end portion 404 of the shaft 214 shown more clearly in FIG. 4 may similarly extend beyond the opening of the housing 102 at the end portion 114 of the housing 102.

In some alternative embodiments, the housing 102 may have a different shape than shown without departing from the scope of this disclosure. In some alternative embodiments, the mounting structures, such as the mounting structures 118-124, may have a different shape and/or configuration that shown without departing from the scope of this disclosure. In some alternative embodiments, the flexure springs of the centralizer 100 may be attached to the end portions 112, 114 of housing 102 in a different manner than described above without departing from the scope of this disclosure.

Figure 8A:
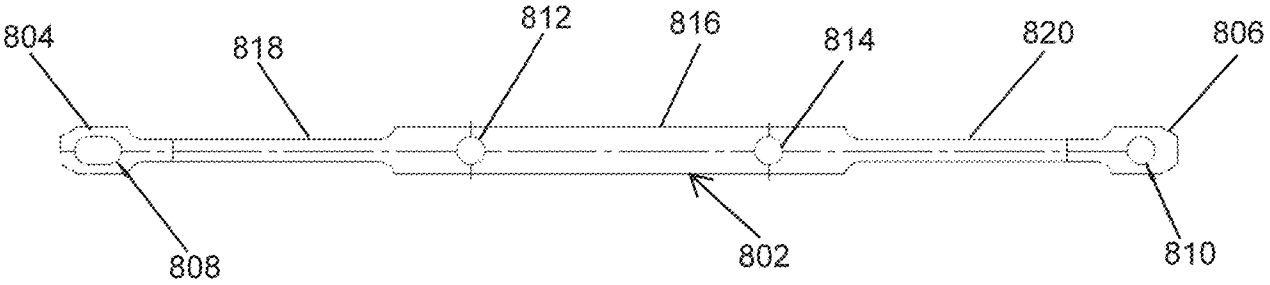
FIG. 8A illustrates a side view of a flexure spring of the high speed rotor dynamics centralizer of FIG. 1 according to an example embodiment.
Figure 8B:
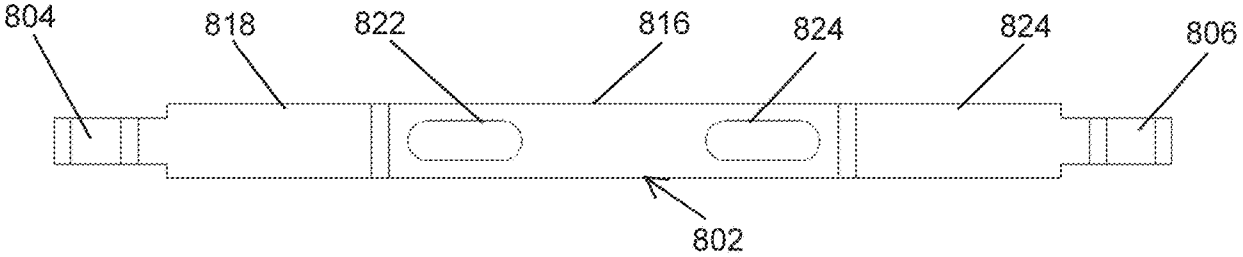
FIG. 8B illustrates a top view of a flexure spring of the high speed rotor dynamics centralizer of FIG. 1 according to an example embodiment.

FIG. 8A illustrates a side view of a flexure spring 802 of the high speed rotor dynamics centralizer 100 of FIG. 1 according to an example embodiment, and FIG. 8B illustrates a top view of the flexure spring 802 of the high speed rotor dynamics centralizer 100 of FIG. 1 according to an example embodiment. For example, the flexure spring 802 may correspond to each of the flexure springs 104, 106, 302 of the centralizer 100. Referring to FIGS. 1-8B, in some example embodiments, the flexure spring 802 includes attachment end portions 804, 806 that are at opposite ends of the flexure spring 802. For example, the attachment end portions 804, 806 may be sized to fit between the frames of the respective attachment structures (e.g., the attachment structures 118, 120). The flexure spring 802 may include an elongated attachment hole 808 at the end portion 804 and a circular attachment hole 810 at the end portion 806. For example, the elongated attachment hole 808 may correspond to the elongated attachment hole 502 of the flexure spring 104. The elongated attachment hole 808 may be sized such that the clevis pin (e.g., the clevis pin 130) attaching the flexure spring 802 to a mounting structure (e.g., the mounting structure 118) of the housing 102 may be at different lateral positions in the elongated attachment hole 808 depending on the compression force applied on the flexure spring 802. The circular attachment hole 810 may be sized such that the clevis pin (e.g., the clevis pin 132) attaching the flexure spring 802 to the mounting structure (e.g., the mounting structure 120) is substantially laterally fixed in the circular attachment hole 810 regardless of the compression force applied on the flexure spring 802. Alternatively, the circular attachment hole 810 may be sized to allow some change of the lateral position of the clevis pin in the hole 810. In some alternative embodiments, the attachment hole 810 may be an elongated hole, and the attachment hole 808 may be a circular hole.

In some example embodiments, the flexure spring 802 may include narrow sections 818, 820 and a wide section 816 that is between the narrow sections 818, 820. The wide section 816 may include slots 822, 824, where a respective roller wheel can be positioned in each slot 822, 824. For example, the slot 822 may correspond to the slot 216 shown in FIG. 2. The wide portion 816 may also include attachment holes 812, 814 that are each connected to the respective one of the slots 822, 824. The wide portion 816 may also include corresponding attachment holes across the slots 822, 824. For example, a clevis pin (e.g., the clevis pin 138) can extend through the attachment hole 812 and the attachment hole across the slot 822 and through a hole in a roller wheel (e.g., the roller wheel 134) positioned in the slot 822 to rotatably attach the roller wheel to the flexure spring 802. Another clevis pin may similarly rotatably attach another roller wheel positioned in the slot 824. In general, a respective roller wheel (e.g., the roller wheel 134 or 136) is positioned in the slot 822, 824 such that the roller wheel is partially positioned outside of the slot 822, 824 at least on a side of the flexure spring 802 that would face a tubing when the centralizer 100 is placed in the tubing.

In some example embodiments, the narrow sections 818 are geometry primarily utilized and defined to obtain a specific spring rate, which dictates the amount of preload applied when the centralizer 100 is inserted into the tubing for any given application. The thicker the section 810, the higher the spring rate and thus the higher the preload. In some example embodiments, the narrow sections 818, 820 may also help reduce the resistance to the flow of fluid around the centralizer 100 in contrast to a flexure spring that is entirely or mostly as wide as the wide section 816. In general, the flexure spring 802 may have curved joints between adjoining surfaces where applicable to reduce resistance to fluid flow on the outside of the housing 102. In some alternative embodiments, the flexure spring 802 may have a different shape than shown without departing from the scope of this disclosure. In some alternative embodiments, the attachment holes 810-814 may each have a different shape than shown without departing from the scope of this disclosure.

Figure 9A:
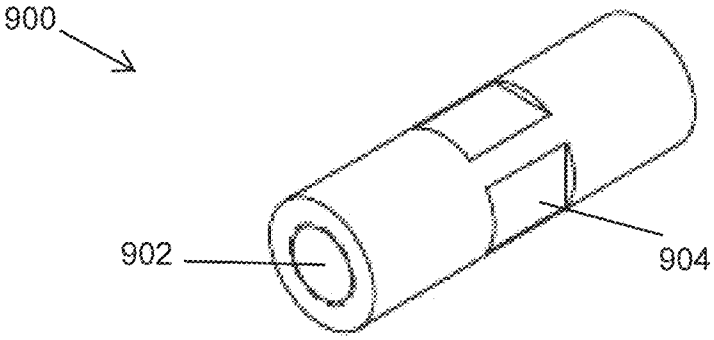
FIGS. 9A-9C illustrate different views of a coupler of the high speed rotor dynamics centralizer of FIG. 1 according to an example embodiment.
Figure 9B:
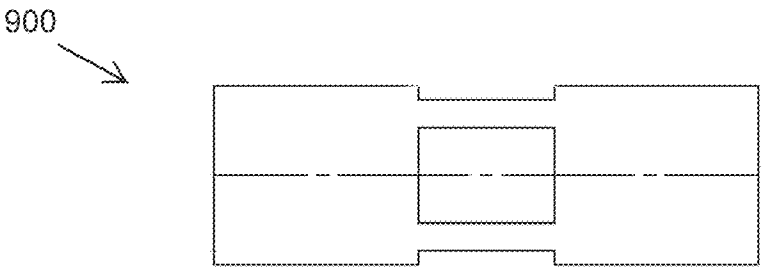
Figure 9C:
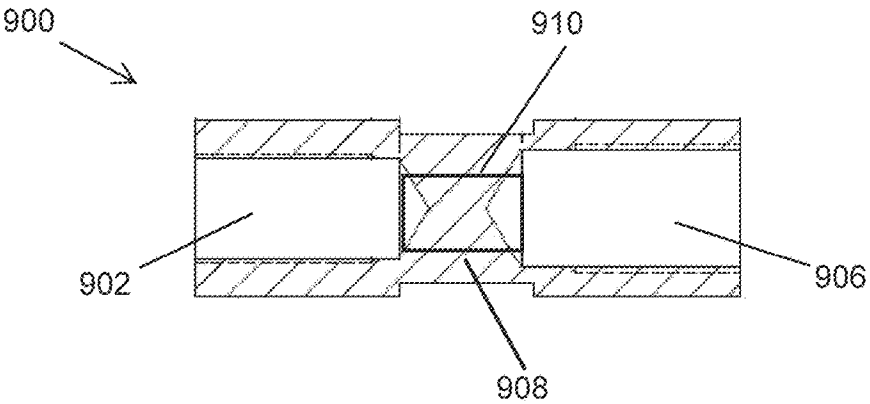

FIGS. 9A-9C illustrate different views of a coupler 900 of the high speed rotor dynamics centralizer 100 of FIG. 1 according to an example embodiment. In particular, FIG. 9A shows a perspective view of the coupler 902, FIG. 9B shows a side view of the coupler 900, and FIG. 9C shows a cross-sectional view of the coupler 900. Referring to FIGS. 1-9C, in some example embodiments, the couple 900 may correspond to the couplers 108, 110 shown, for example, in FIG. 1. In some example embodiments, the coupler 900 may include notches 904 on the outside of the coupler that may facilitate grasping the coupler 900 for attaching or detaching the coupler to/from the housing 102 of the centralizer 100. The coupler 900 may also include threaded holes 902, 906 that are separated from each other by a middle section 908. For example, the shaft 214 shown in FIG. 2 may be attached to the coupler 902 by inserting the threaded end portion of the shaft 402 in the threaded hole 902, and a rod may be attached to the coupler 902 by inserting a threaded end portion of the rod in the threaded hole 906. Alternatively, the shaft 214 shown in FIG. 2 may be attached to the coupler 902 by inserting the threaded end portion of the shaft 402 in the threaded hole 906, and a rod may be attached to the coupler 902 by inserting a threaded end portion of the rod in the threaded hole 902.

In some alternative embodiments, instead of fully separating the attachment holes 902, 906 from each other, the middle section 908 may have include a channel 910 that provides a path for fluid to flow between the attachment holes 902, 906. For example, the shaft 214 may be hollow and may allow a fluid to flow therethrough, and the fluid flowing through the shaft 214 mass through the coupler 900 through the channel 910. Alternatively or in addition, the channel 910 may allow some of the fluid flowing on the outside of the housing 102 to pass through the coupler 900.

In some alternative embodiments, the coupler 900 may have a different shape and/or different features than shown without departing from the scope of this disclosure. In some example embodiments, the threaded holes 902, 906 may be partially threaded. Alternatively, the threaded holes 902, 906 may be fully threaded. In some example embodiments, the threaded holes 902, 906 may be different sizes without departing from the scope of this disclosure.

Figure 10:
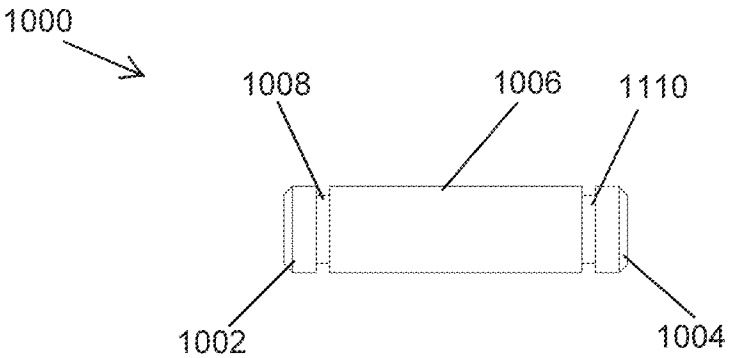
FIG. 10 illustrates a clevis pin for use in the high speed rotor dynamics centralizer of FIG. 1 according to an example embodiment.

FIG. 10 illustrates a clevis pin 1000 for use in the high speed rotor dynamics centralizer 100 of FIG. 1 according to an example embodiment. Referring to FIGS. 1-10, in some example embodiments, the clevis pin 1000 may correspond to each clevis pins of the centralizer 100, such as the clevis pins shown in FIGS. 1-5. In some example embodiments, the clevis pin 1000 may include end portions 1002, 1004 at opposite ends of the clevis pin 1000 separated from a middle portion 1006 of the clevis pin 1000 by grooves 1008, 1110. For example, respective retainers may be inserted in the grooves 1008, 1110 to retain the clevis pin 1000 after the clevis pin 1000 is inserted in one or more attachment holes of a mounting structure (e.g., the mounting structure 118) or a flexure spring (e.g., the flexure spring 104). In some alternative embodiments, the clevis pin 1000 may have a different shape than shown without departing from the scope of this disclosure. In some alternative embodiments, the clevis pin 1000 may have a different end portion than shown without departing from the scope of this disclosure.

Figure 11:
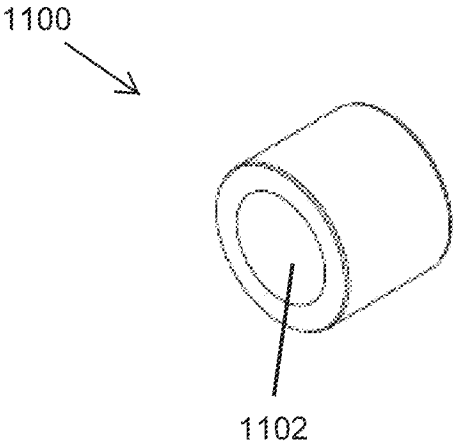
FIG. 11 illustrates a bearing for use in the high speed rotor dynamics centralizer of FIG. 1 according to another example embodiment.

FIG. 11 illustrates a bearing 1100 for use in the high speed rotor dynamics centralizer 100 of FIG. 1 according to another example embodiment. Referring to FIGS. 1-11, in some example embodiments, the bearing 1100 may be a journal bearing that is a different type from the bearing 202 shown, for example, in FIG. 2. For example, the bearing 202 may be a plain bearing, and the bearing 1100 may be used instead of the bearing 202 without departing from the scope of this disclosure. To illustrate, the bearing 1100 may be fixedly attached to the housing 102 in the cavity of the housing 102 at the respective end portion 112, 114 of the housing 102 such that the shaft 214 extends through the opening 1102 of the bearing 1100 and rotates relative to the bearing 1100. In some example embodiments, the bearing 1100 may enable use of the centralizer 100 in a relatively higher temperature but lower speed environment in contrast to the bearing 202. The bearing 1100 may be made from a suitable material, such as graphite or uniform solid metal and graphite combinations as can be readily understood by those of ordinary skill in the art with the benefit of this disclosure.

Figure 12:
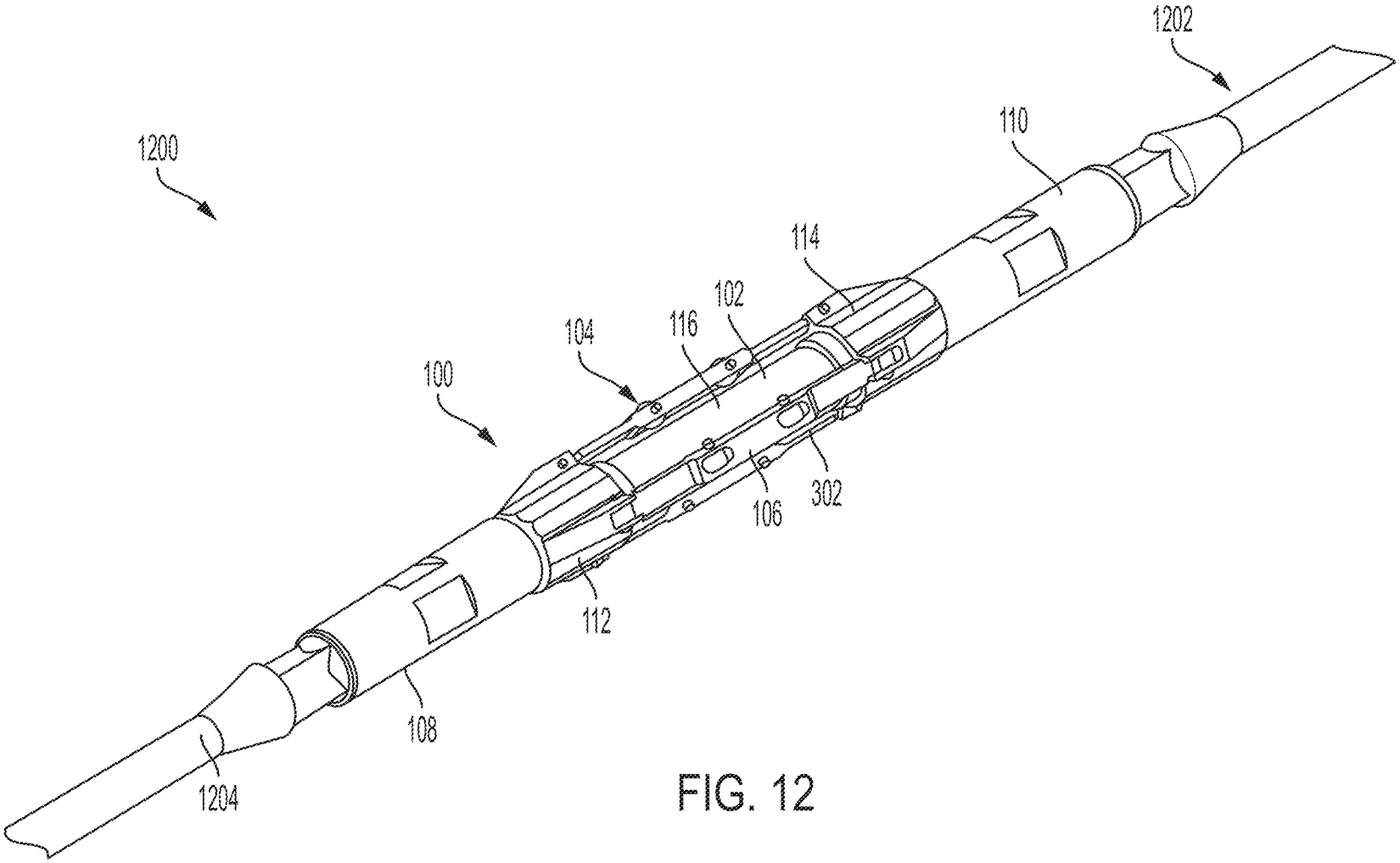
FIG. 12 illustrates the high speed rotor dynamics centralizer of FIG. 1 coupled to rotatable rods according to an example embodiment.

FIG. 12 illustrates the high speed rotor dynamics centralizer 100 of FIG. 1 coupled to rotatable rods 1202, 1204 according to an example embodiment. Referring to FIGS. 1-12, as described above, the centralizer 100 may include the couplers 108, 110 at opposite ends of the centralizer 100. For example, the rod 1202 is coupled to the coupler 110, and the rod 1204 is coupled to the coupler 108. To illustrate, the rods 1202, 1204 may have threaded end portions that are screwed into the respective coupler 110, 108. The rods 1202, 1204 are coupled to the centralizer 100 by the couplers 110, 108 such that the rods 1202, 1204 rotate along with the couplers 108, 110 while the housing 102 remains rotationally static. The flexure springs 104, 106, 302 are attached to the housing 102 at the end portions 112, 114 and spaced from the middle portion 116.

In some example embodiments, the rods 1202, 1204 may be standard rods or may be non-standard (e.g., tubular/hollow, pre-balanced, etc.), and the couplers 108, 110 may be designed to accommodate various connection types (e.g., API, Proprietary Service, etc.). As described above, the shaft 214 may also be hollow such that the rods 1202, 1204 are fluidly coupled through the shaft 214 and the couplers 108, 110. In some alternative embodiments, the rods 1202, 1204 may be attached to the centralizer 100 in a different manner than shown without departing from the scope of this disclosure.

Figure 13:
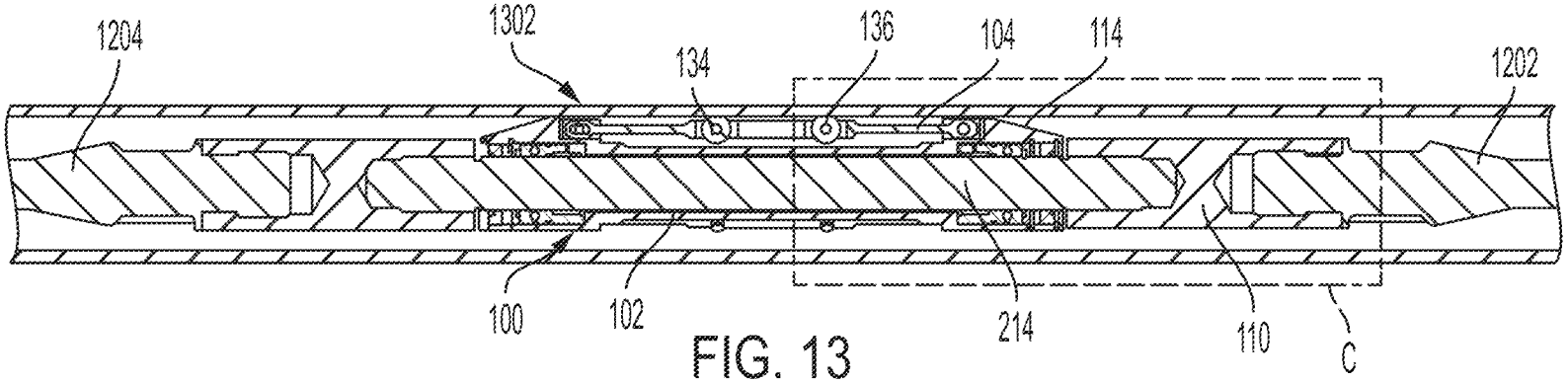
FIG. 13 illustrates the high speed rotor dynamics centralizer of FIG. 1 coupled to rotatable rods and positioned in a tubing according to an example embodiment.

FIG. 13 illustrates the high speed rotor dynamics centralizer 100 of FIG. 1 coupled to rotatable rods 1202, 1204 and positioned in a tubing 1302 according to an example embodiment. Referring to FIGS. 1-13, in some example embodiments, the flexure springs 104, 106, 302 are attached to the housing 102 of the centralizer 100 to elastically deflect upon the insertion of the centralizer 100 into the tubing 1302. To illustrate, the tubing 1302 has an inner diameter that results in the roller wheels attached to the flexure springs 104, 106, 302 coming in contact with the inner surface of the tubing such that the flexure springs 104, 106, 302 are deflected toward the middle portion 116 of the housing 102. The deflection of the flexure springs toward the middle section 116 causes a preload force to be induced between each flexure spring/roller wheels assembly and the tubing 1302. The preload forces result in balanced normal forces that centralize the housing 102 and the rods 1202, 1204 with respect to the tubing 1302.

In some example embodiments, the longitudinal orientation of the roller wheels with respect to the tubing 1302 resists the rotational motion of the housing 102 and the flexure springs 104, 106, 302 with respect to the tubing while facilitating the axial insertion and movement of the centralizer 100 through the tubing 1302. To illustrate, the preload forces on the flexure springs 104, 106, 302 result in friction between the roller wheels attached to the flexure springs 104, 106, 302 and the tubing 1302, where the friction resists the rotational motion of the housing 102 and the flexure springs 104, 106, 302 with respect to the tubing 1302. As can be seen in FIG. 13, the roller wheels (e.g., the roller wheels 134, 136) of the centralizer 100 can remain spaced from the middle section 116 of the housing 102 while the flexure springs 104, 106, 302 are preloaded as a result of insertion in the tubing 1302.

Because the shaft 214 is rotatable relative to the housing 102 that can remain generally rotationally static and because the shaft 214 is attached to the couplers 108, 110 that are also coupled to the rods 1202, 1204, the shaft 214 rotates along with the rods 1202, 1204. The shaft 214 and the rods 1202, 1204 may be coupled to couplers 108, 110 to rotate in a desired direction.

In some example embodiments, multiple ones of the centralizer 100 may be placed in the tubing 1302, where adjacent ones are connected by a respect rod or rod strings and spaced from each other, for example, in a range of about 5 feet to about 30 feet.

Figure 14:
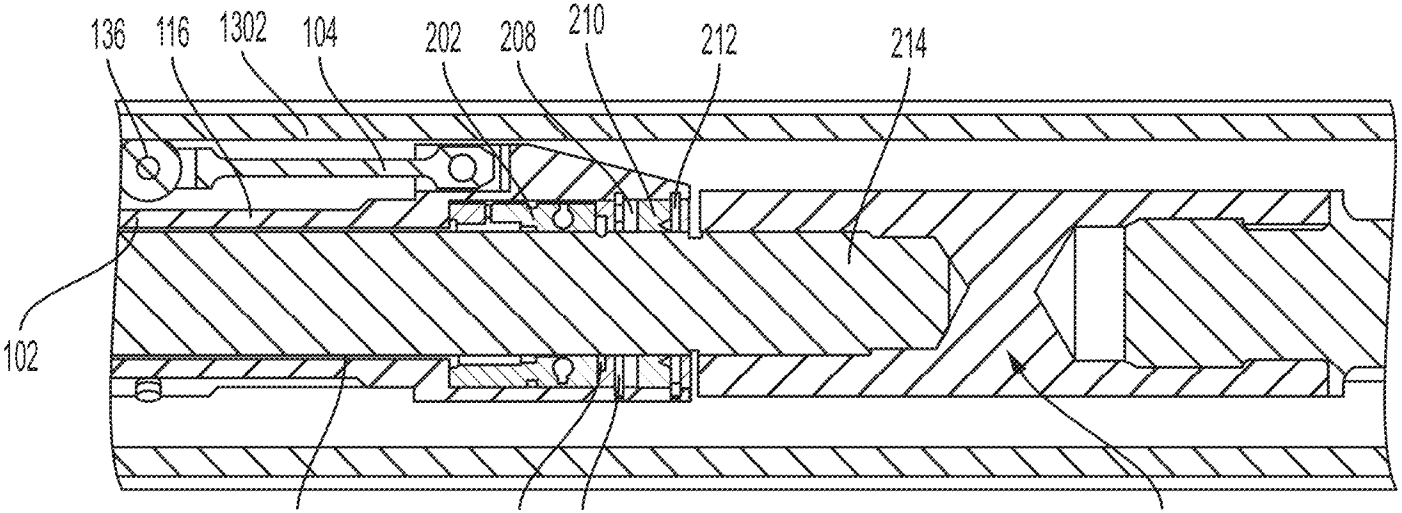
FIG. 14 illustrates a close-up view of a portion C of the high speed rotor dynamics centralizer shown in FIG. 13 according to an example embodiment.

FIG. 14 illustrates a close-up view of a portion C of the high speed rotor dynamics centralizer shown in FIG. 13 according to an example embodiment. Referring to FIGS. 1-14, in some example embodiments, the bearing 202, the retaining ring 204, the retaining ring 206, the seal backing ring 208, the shaft seal 210, and the retaining ring 212 are positioned at the end portion 114 of the housing 102 in a similar manner as their counterpart components are positioned at the end portion 112 of the housing 102. As more clearly shown in FIG. 14, the retaining ring 204 is positioned around the end portion of the shaft 214 to retain the bearing 202 in place.

In some example embodiments, the retaining rings 206, 212, the seal backing ring 208, and the shaft seal 210 may also be at least partially positioned around the end portion of the shaft 214. The retaining rings 206, 212 may retain the seal backing ring 208 and the shaft seal 210 in place. The cavity 714 of the housing 102 may be hermetically sealed by the shaft seal 210, and the cavity 714 may serve as a reservoir for containing a lubricant to lubricate the bearing 202. As described above, in some alternative embodiments, a different type of bearing may be used than the bearing 202 without departing from the scope of this disclosure.

As more clearly shown in FIG. 14, the roller wheel 136 is in contact with the inner surface of the tubing 1302 such that the flexure spring 104 is deflected/compressed (thus, preloaded) toward the middle portion 116. Although the roller wheel 136 is in contact with the inner surface of the tubing 1302, the roller wheel 136 remains spaced from the middle portion 116. At least the roller wheels that are attached to the other flexure springs 106, 302 and that are circularly aligned with the roller wheel 136 are similarly in contact with the inner surface of the tubing 1302 such that the flexure springs 106, 302 are deflected/compressed toward the middle portion 116.

In some example embodiments, the rods 1202, 1204 may be attached to the shaft 214 using means other than or in addition to the couplers 108, 110 without departing from the scope of this disclosure. In some alternative embodiments, the centralizer 100 may include more than three flexure springs without departing from the scope of this disclosure. In some alternative embodiments, the flexure springs 104, 106, 302 may be attached to the housing 102 in a different manner than shown in the figures without departing from the scope of this disclosure.

Figure 15A:
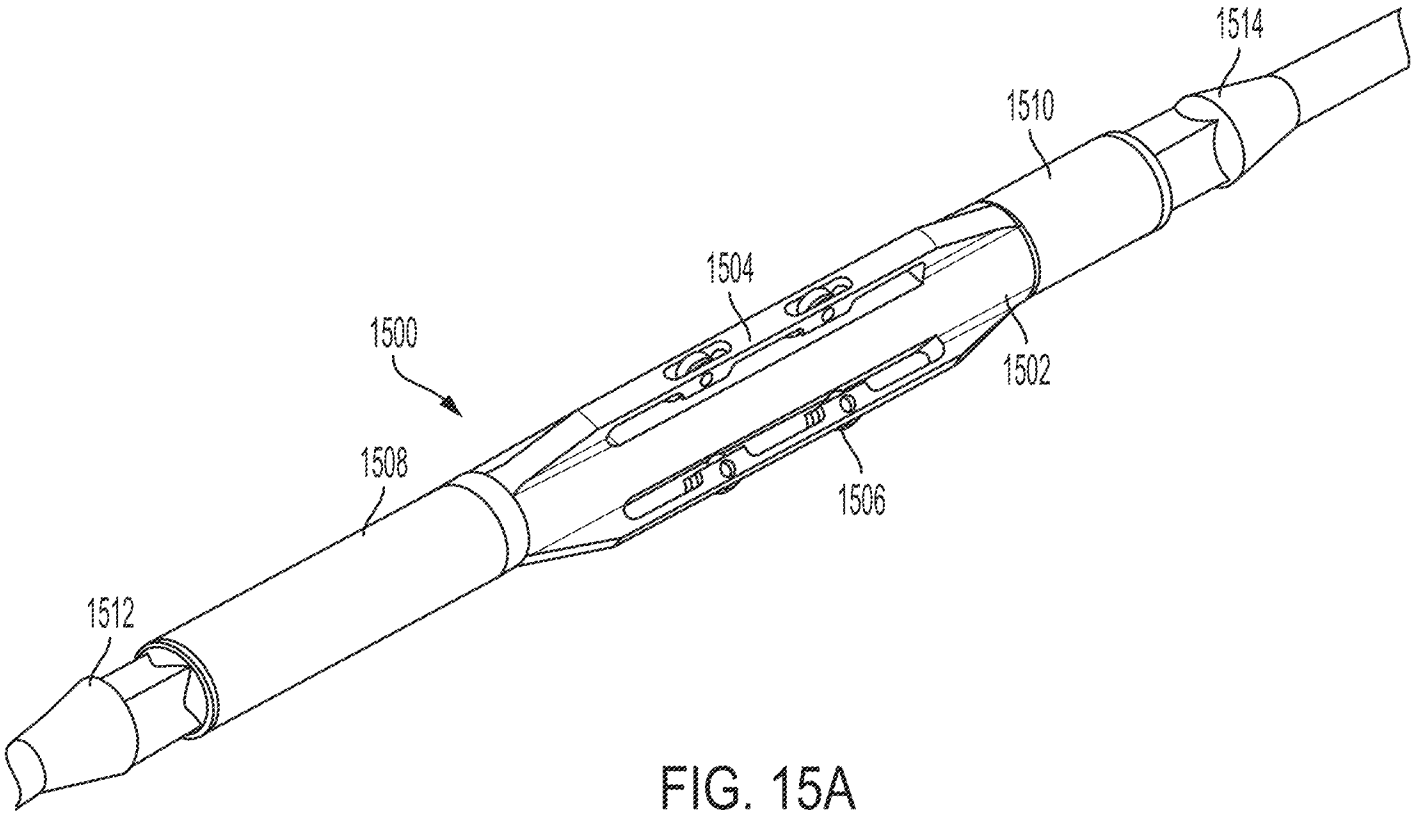
FIGS. 15A and 15B illustrate a high speed rotor dynamics centralizer according to another example embodiment.
Figure 15B:
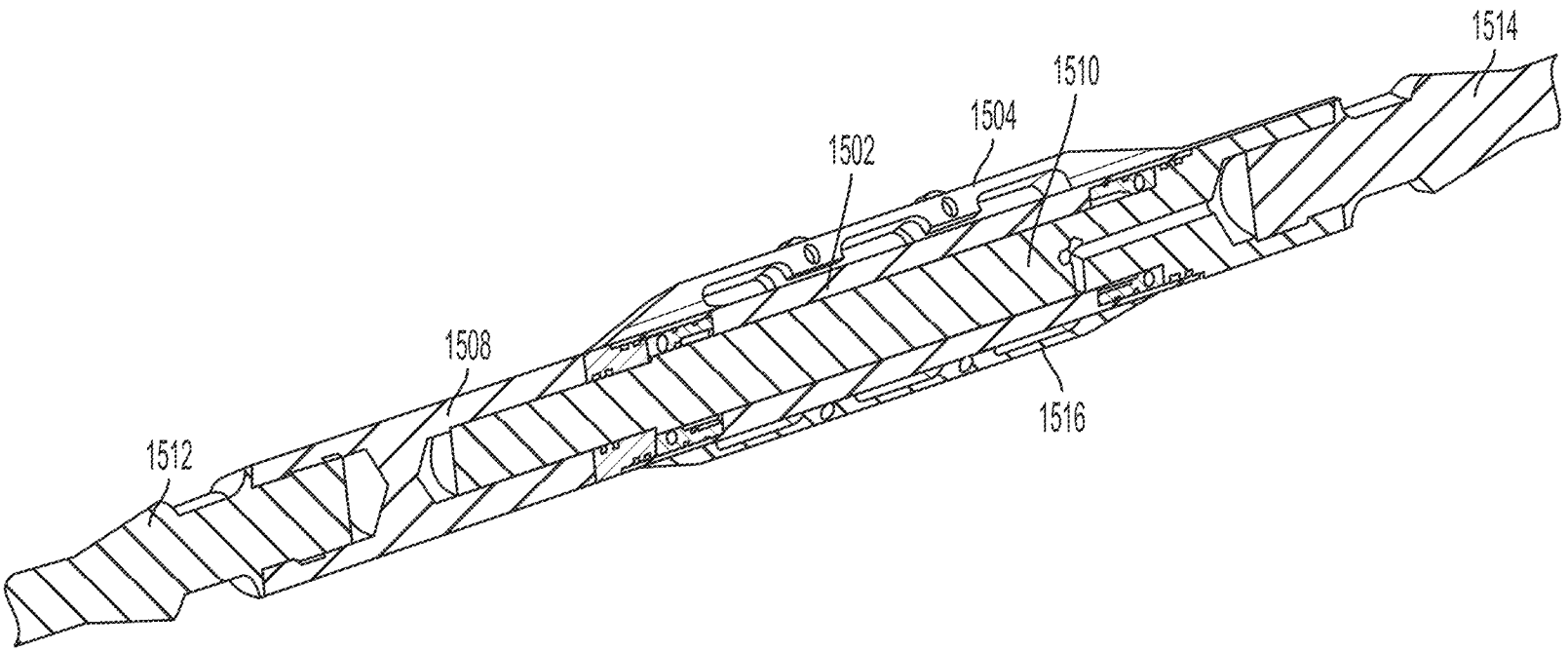

FIGS. 15A and 15B illustrate a high speed rotor dynamics centralizer 1500 according to another example embodiment. In general, the centralizer 1500 is substantially similar to the centralizer 100. To illustrate, in some example embodiments, the centralizer 1500 includes a housing 1502, flexure springs 1504, 1506, 1516 that are attached to the housing 1502. Two roller wheels may be rotatably attached to each of the flexure springs 1504, 1506, 1516 in a similar manner as described with respect to the centralizer 100. For example, the roller wheels may correspond to the roller wheels 134, 136 described above with respect to FIG. 1. Each roller wheel may be positioned in a respective slot, similar to the slots 822, 824 shown in FIG. 8, and may be attached to the respective the flexure spring 1504, 1506, 1516. To illustrate, clevis pins may be used to attach the roller wheels to flexure springs 1504, 1506, 1516 in a similar manner as described with respect to the centralizer 100. Alternatively, the roller wheels may be attached to flexure springs 1504, 1506, 1516 using other means as can be contemplated by those of ordinary skill in the art with the benefit of this disclosure.

As shown in FIGS. 15A and 15B, the roller wheels may extend beyond the flexure springs 1504, 1506, 1516 such that the flexure springs 1504, 1506, 1516 are in contact with the inner surface of a tubing, such as the tubing 1302, and such that the flexure springs 1504, 1506, 1516 are not in direct contact with the tubing when the centralizer 1500 is positioned in the tubing. As shown in FIGS. 15A and 15B, the roller wheels are oriented to facilitate the insertion of the centralizer 1500 into a tubing and to resist the rotation of the housing 1502 and the flexure springs 1504, 1506, 1516 relative to the tubing in a similar manner as described above with respect to the roller wheels of the centralizer 100. The flexure springs 1504, 1506, 1516 may be shaped to obtain a specific spring rate, which dictates the amount of preload applied when the centralizer 1500 is inserted into a tubing such that the roller wheels and the flexure springs 1504, 1506, 1516 are pushed toward the housing 1502 of the centralizer 1500 by the tubing.

In some example embodiments, the flexure springs 1504, 1506, 1516 are 120 degrees apart around the housing 1502. In contrast to the flexure springs of the centralizer 100 of FIG. 1, the flexure springs 1504, 1506, 1516 may be integrally formed with the housing 1502 instead of being attached to the housing 1502 using clevis pins or other similar attachment devices. For example, the flexure springs 1504, 1506, 1516 may be formed such that the middle portion of each flexure spring 1504, 1506, 1516 is spaced from the housing 1502 while end portions of each flexure springs 1504, 1506, 1516 are attached to housing 1502. The shape and thickness of portions of the flexure springs 1504, 1506, 1516 may be designed such that each the flexure spring 1504, 1506, 1516 as a desired spring rate.

In some example embodiments, a shaft 1510 may extend through a cavity of the housing 1502, where end portions of the shaft 1510 are positioned outside of the housing 1502 and a middle portion of the shaft 1510 is inside the housing 1502. The shaft 1510 may be attached to a coupler 1508 at one end of the shaft 1510. For example, the coupler 1508 may correspond to the coupler 108 shown in FIG. 1. To illustrate, a rod 1512 may be attached to the coupler 1508 in a similar manner as described with respect to the centralizer 100. In contrast to the centralizer 100, the shaft 1510 may include a coupler end that functions as a coupler, where a rod 1514 is attached to the coupler end of the shaft 1510 instead of to a standalone coupler. The shaft 1510 may be coupled to the rods 1512, 1514 by the coupler 1508 and directly such that the shaft 1510 rotates along with the rods 1512, 1514. To illustrate, bearings corresponding to the bearings of the centralizer 100 may be positioned in the housing 1502 such that the shaft 1510 extends through the bearings, where the shaft 1510 rotates relative to the housing 1502. The cavity of the housing 1502 may contain a lubricant to lubricate the bearings. For example, the cavity of the housing 1502 may be hermetically sealed by shaft seals in a similar manner as described with respect to the centralizer 100. In some example embodiments, the shaft 1510 may include a pathway for placing the lubricant in the cavity of the housing 1502 after the shaft 1510 is positioned in the housing 1502 as shown in FIGS. 15A and 15B.

In general, the components of the centralizer 1500 may be made from the same material as described with respect to the centralizer 100. In some example embodiments, some of the components of the centralizer 1500 may have different shapes than shown without departing from the scope of this disclosure. In some alternative embodiments, some of the components of the centralizer 1500 may be used instead of or in addition to the components of the centralizer 100 without departing from the scope of this disclosure. In some example embodiments, the centralizer 1500 may be used instead of the centralizer 100 without departing from the scope of this disclosure.

Referring to FIGS. 1-15B, by using the combination of the flexure springs, bearings, and roller wheels as described above, the centralizer 100, 1500 can be used to center rods/rod strings in a tubing such as the tubing 1302. By providing open spaces between and around the flexure springs, the centralizer 100, 1500 may present less resistance to the flow of fluid around the centralizer 100, 1500 in contrast to a centralizer that relies on vanes to achieve the centering of attached rods. Further, in contrast to a centralizer that uses rigid vanes for centering rods/rod strings, the compliancy and design flexibility of the flexure springs of the centralizer 100, 1500 enable the centralizer 100, 1500 to be used with various diameter tubing. In contrast to spring bow-spring centralizers, which are primarily used to keep casing in the center of a wellbore or additional casing prior to and during a cement job, the centralizer 100, 1500 can be used to center rods/rod strings in applications that require relatively high speed rotation of the rods/rod strings as they incorporate aforementioned housing, bearing and rolling elements. The centralizer 100, 1500 may be used in various applications including oil and gas related operations.

Figure 16:
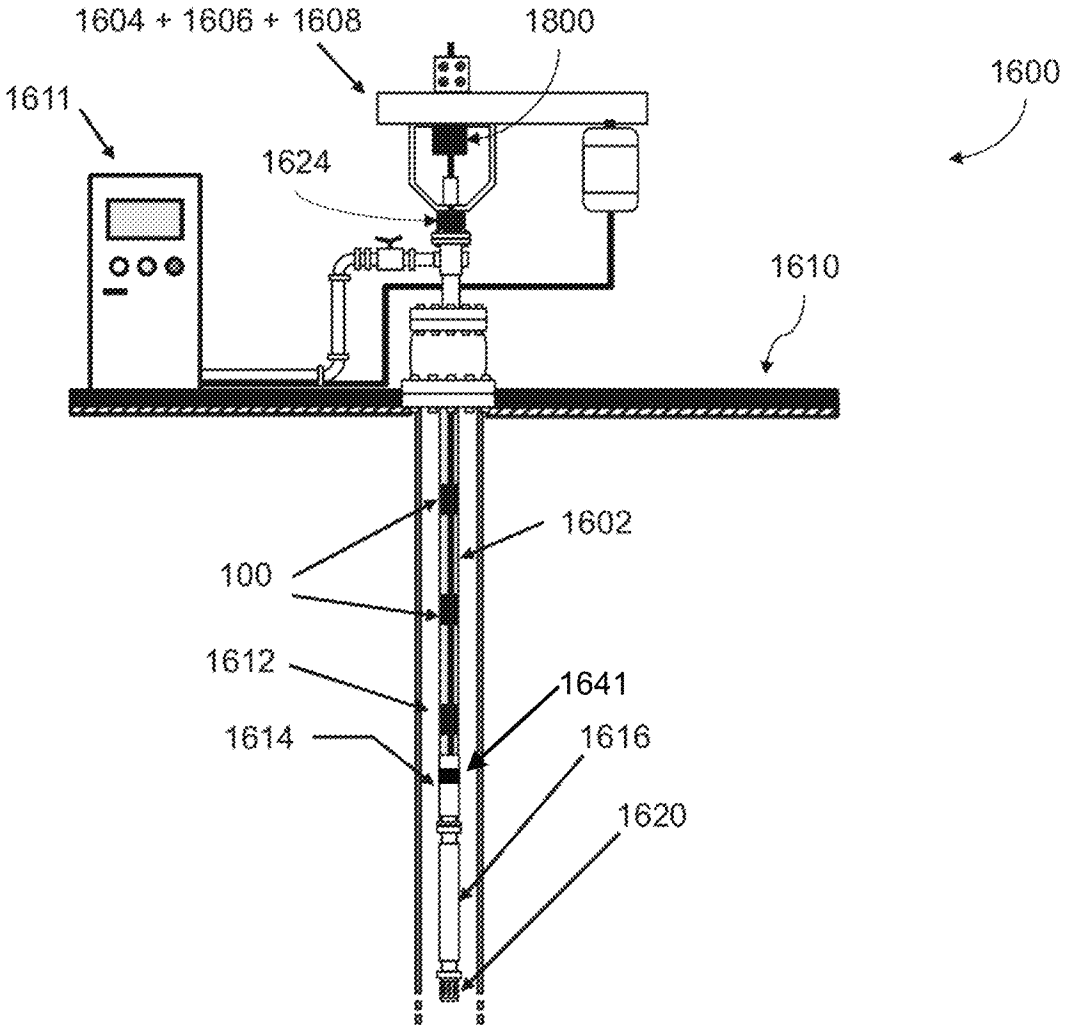
FIG. 16 is a schematic of an artificial lift system, according to an exemplary embodiment.

Referring to FIG. 16, an exemplary embodiment of a geared centrifugal pump (GCP) system 1600 for artificial lift applications is shown. A standard API rod string 1602, or specialized rod, or drive rod, is centralized within the system 1600 using one or more centralizers 100 of the present invention. In certain alternative embodiments, centralizers 1500 can be used in the system. In certain embodiments, a head drive 1604, belt/sheave 1606, and motor 1608 operate to spin the rod string 1602 at about 400-500 revolutions per minute (rpm) at the surface 1610. A variable speed drive (VSD) 1611 may be utilized to control the speed of the motor 1608. In certain embodiments, a rotating on-off tool 1612 is utilized to guide and engage the rod string 1602 to a downhole transmission 1614. In certain exemplary embodiments, the downhole transmission 1614 steps up the rotation of the rod string 1602 from a lower rpm input from surface 1610 to a speed of up to about 1800 rpm, or ~30 Hertz (Hz), to operate a downhole pump 1616 coupled to a pump intake 1620 where well fluid enters the system. In certain exemplary embodiments, the downhole transmission 1614 steps up the rotation of the rod string 1602 from a lower rpm input from surface 1610 to a speed of up to about 3600 rpm, or ~60 Hz, to operate the downhole pump 1616. In certain exemplary embodiments, the downhole transmission 1614 steps up the rotation of the rod string 1602 from a lower rpm input from surface 1610 to a speed of up to about 4200 rpm, or ~70 Hz, to operate the downhole pump 1616. In certain exemplary embodiments, the downhole transmission 1614 allows for tension generated by the downhole pump 1616 to be transferred towards rod string 1602. In certain exemplary embodiments, a cooling system 1624 may be included to help dissipate heat and keep the head drive from building up too much friction. In certain exemplary embodiments, a cooling system 1641 for the downhole transmission 1614 allows for pressure compensation, e.g. balances the inner pressure of the rod string 1602 according to the external pressure, and also allows for tension transfer. For instance, the downhole transmission 1614 allows for transferring thrust created by downhole pump 1616 toward the rod string 1602. One having ordinary skill in the art will recognize appropriate cooling systems (e.g., cooling system 1641, cooling system 1624) to utilize with the systems of the present invention.

Figure 17:
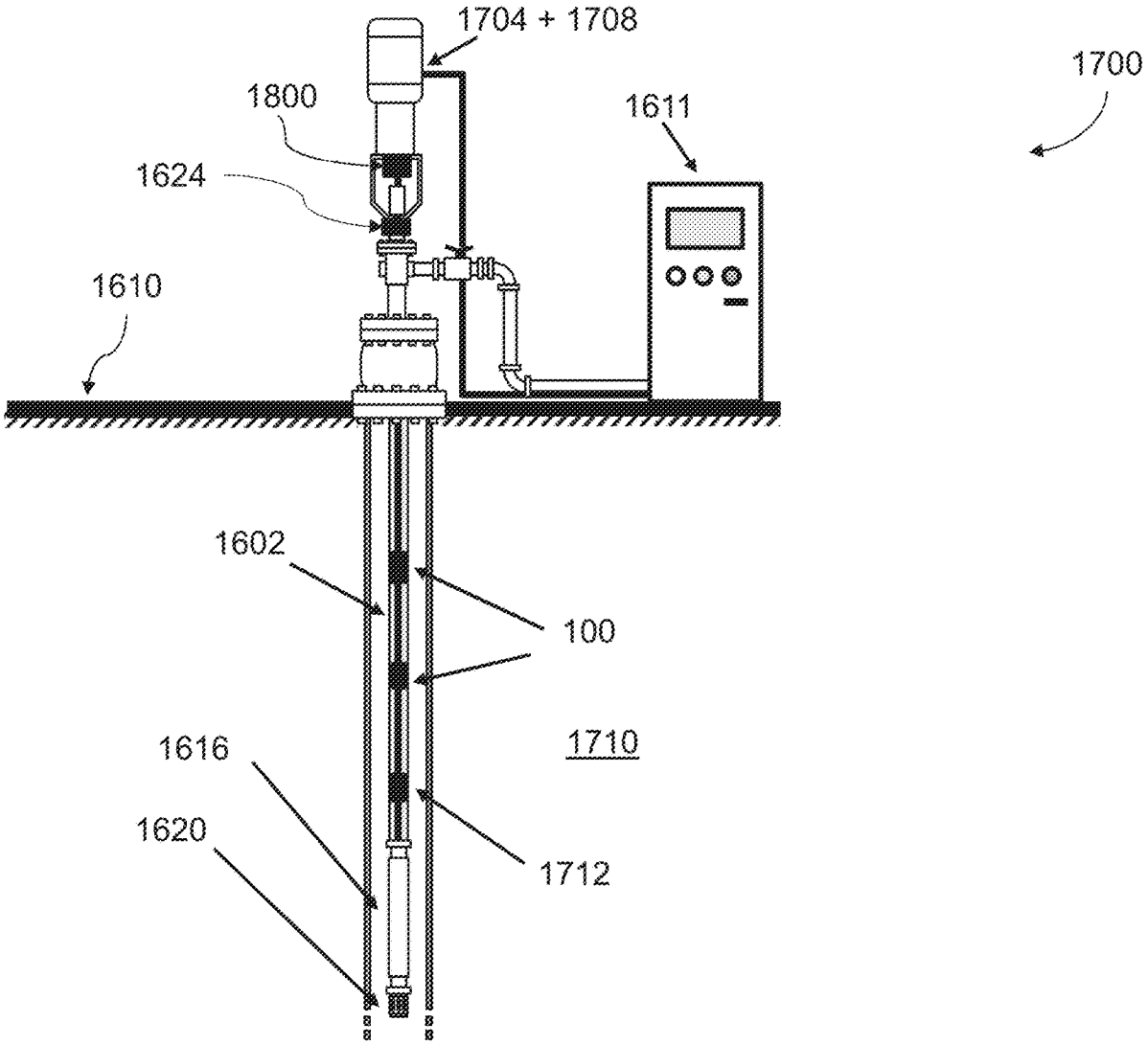
FIG. 17 is a schematic of an artificial lift system, according to another exemplary embodiment.

Referring to FIG. 17, an exemplary embodiment of a direct drive pump (DDP) system 1700 for artificial lift applications is shown. The system 1700 is the same as that described above with regard to system 1600, except as specifically stated below. For the sake of brevity, the similarities will not be repeated hereinbelow.

A rod string 1602 is centralized within the system 1700 using centralizers, such as centralizers 100, of the present invention. In certain embodiments, a direct head drive 1704 and motor 1708 operate to spin the rod string 1602 at equal rpm at the surface 1610 and downhole 1710, at a speed up to about 1800 rpm, to operate a downhole pump 1616. In certain embodiments, the direct head drive 1704 and motor 1708 operate to spin the rod string 1602 at equal rpm at the surface 1610 and downhole 1710, at a speed up to about 3600 rpm, to operate the downhole pump 1616. In certain embodiments, the direct head drive 1704 and motor 1608 operate to spin the rod string 1602 at equal rpm at the surface 1610 and downhole 1710, at a speed up to about 4200 rpm, to operate the downhole pump 1616. A variable speed drive (VSD) 1611 may be utilized to control the speed of the motor 1708. In certain embodiments, a rotating on-off tool 1712 is utilized to guide and engage the rod string 1602 to the downhole pump 1616.

In the systems shown in FIGS. 16 and 17, the centralizers 100 may be mounted at various spacing intervals, based on standard rod and pony rod lengths. This is beneficial when a higher number (shorter spacing) is desired (for example, at the lower end of the rod string, where the tensile loading is minimal). In certain exemplary embodiments, the centralizers are spaced apart in a range from about 5 feet to about 30 feet. The centralizers can be mounted using couplers that interface with the threaded rod end and the threaded centralizer shaft. Rods may also be non-standard, (e.g. tubular/hollow, pre-balanced) as the ends of the centralizers can be modified to accommodate various connection types (e.g. API, Proprietary Service). One having ordinary skill in the art will recognize that the centralizers can be mounted using other coupling means.

Whirling is typically seen at high speeds in systems utilizing conventional rod centralizer technology, primarily since they are loosely positioned within the tubing walls and the rod strings are not perfectly balanced. The present invention aims to minimize or avoid the whirling phenomenon, which may lead to failure of the rod string, the downhole pump, or both. Generally, the centralizers of the present invention maintain the rod string centralized and stiffly coupled to the tubing, minimizing lateral vibration and displacement. This stiff coupling creates a vibrational node of minimal (ideally zero) amplitude. In certain exemplary embodiments, the lateral vibration is minimized to be less than 0.156 inch per second, as suggested by API RP 11S8, or 0.2 inch per second RMS, as suggested by API 610. Configuring the spacing/placement of the centralizers along the length of the wellbore while considering the input driving angular velocity allows the systems 1600, 1700 to operate a downhole pump 1616 with manageable (minimized) rod whirling. Referring again to FIGS. 16 and 17, to further minimize rod whirling, the present embodiments may also subject the entire length, or in some embodiments, some portion of rod string 1602 to an induced tension load using a rod string tensioner 1800 (FIG. 18), as described further below. However, one having ordinary skill in the art will recognize that there may be other devices that can be utilized to induce a tension load (e.g. hydraulic thrust bearing). The tension load functions to increase the overall stiffness of the rod string 1602 and thusly the natural frequency of the rod string 1602 above, or not in the regime of, the operational frequency (drive angular velocity). In addition, in certain embodiments, the tubing string can further be centralized (e.g. by applying tension) and coupled to the casing to further stiffen the overall system. Tension may also help to reduce the number of centralizers used in the system, as it allows for the distance or spacing between the centralizers to be increased.

Figure 18:
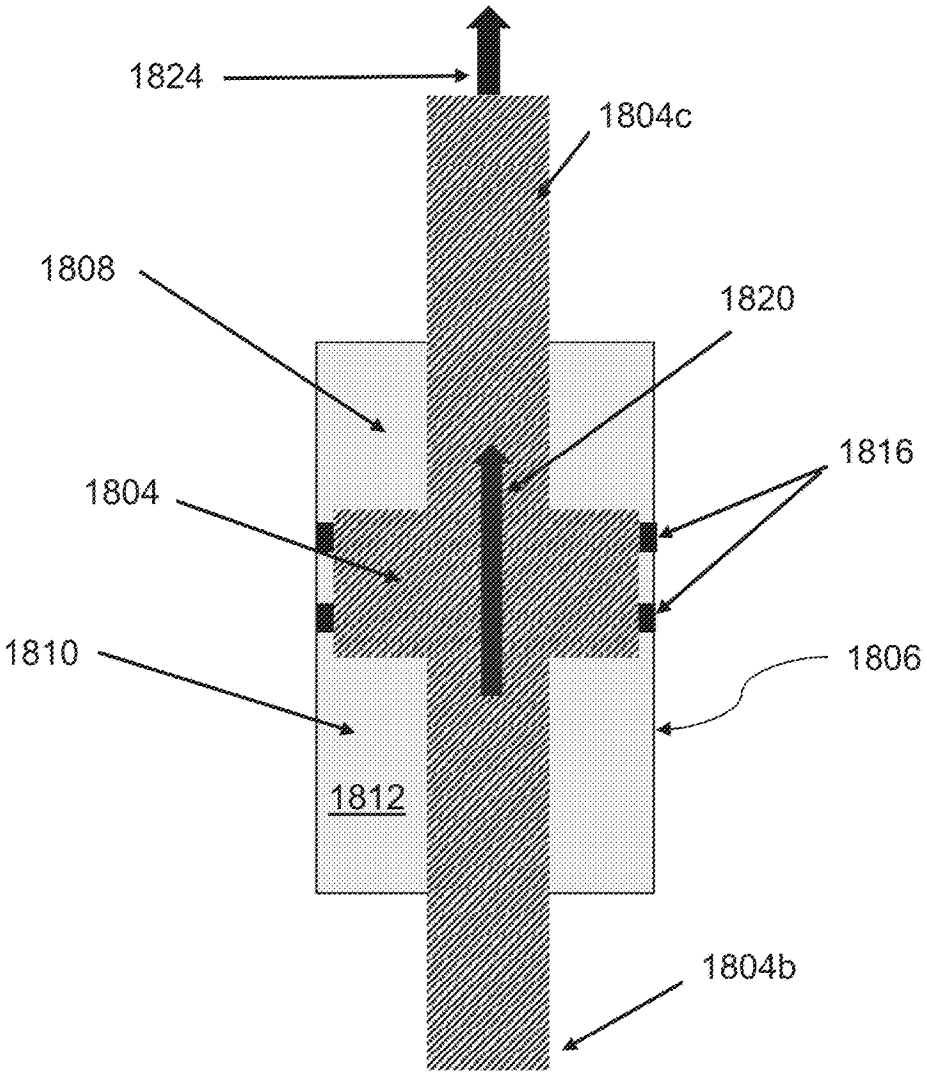
FIG. 18 is a schematic of a rod string tensioner for use in an artificial lift system, according to an exemplary embodiment.

Referring to FIG. 18, an exemplary embodiment of a rod string tensioner 1800 is shown. The rod string tensioner 1800 is a pressurized hydraulic system that applies a tension load to a rod string 1602 (FIGS. 16 & 17). The rod string tensioner 1800 includes a piston assembly 1804 positioned within a housing 1806 having an unpressurized/vented chamber 1808 and a pressurized fluid chamber 1810. The pressurized fluid chamber 1810 contains a pressurized fluid 1812 therein. A central portion 1804*a* of the piston assembly 1804 is sealed within the housing 1806 using fluid seals/bearings 1816. A lower portion 1804*b*, or the rod string output shaft, of the piston assembly 1804 interfaces with the rod string. An upper portion 1804*c*, or the head drive/motor input shaft, of the piston assembly 1804 interfaces the head drive and motor.

The rod string tensioner 1800 is generally designed to preload the rod string with an upward force, and functions by applying pressurized fluid 1812 to the bottom end of the piston assembly 1804 while the top end is vented, which causes the resultant tension load, or net force, 1820 to be vertically loaded upward. The resulting axial displacement allowance 1824 places the rod string in tension. In certain exemplary embodiments, the amount of tension induced on the rod string may vary from system to system, and may be a function of the size of the rod string and metallurgy of the rod string. In certain exemplary embodiments, the induced tension does not exceed the collapse threshold of the rod string.

Figure 19:
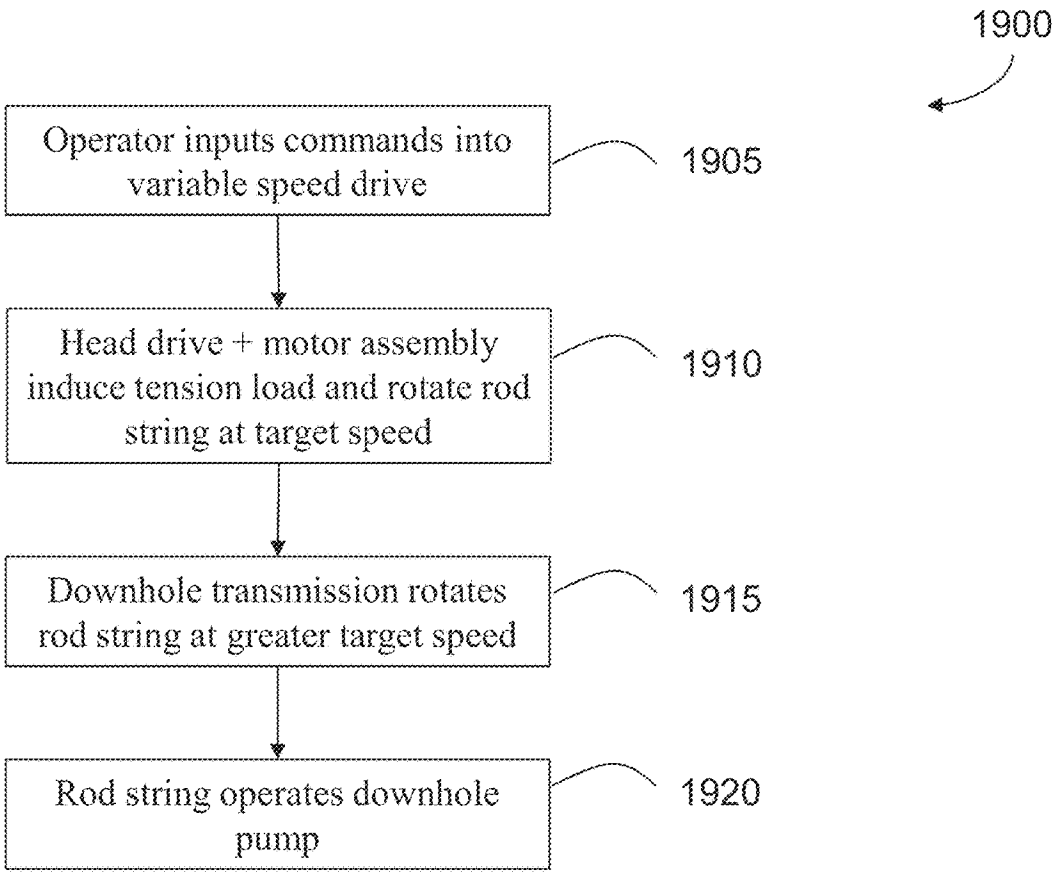
FIG. 19 illustrates a method of operating an artificial lift system, according to an exemplary embodiment.

FIG. 19 illustrates a method 1900 of operating systems 1600, 1700, according to an exemplary embodiment. At 1905, an operator interfaces with a variable speed drive (VSD) to input system commands. At 1910, the commands are interpreted and the head drive/motor assembly effectuate the rod string tensioner and rotate the rod string at a target speed. Once the rod string begins to rotate at surface, the rod string may deform, thus causing the revolutions per minute (RPM) downhole to differ from that at the surface. The centralizers of the present invention help to minimize, or prevent altogether, any tangling or twisting of the rod string during these few seconds. As the rod string at surface spins and increases per minute, the rod string downhole will also increase until the RPMs at both surface and downhole are equal. In certain optional embodiments, at 1915, a downhole transmission rotates the rod string at a second target speed, where the second target speed is greater than the initial target speed. At 1920, the rotating rod string operates the downhole impeller pump. In certain embodiments, a cooling system is utilized to dissipate heat from the head drive/motor assembly (not shown).

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. An artificial lift system for wellbore applications, comprising:

a motor;

a drive selected from the group consisting of: geared centrifugal head drives and direct head drives, wherein the motor and the drive are positioned above a ground surface of a wellbore and are configured to generate a rotational force;

a rod string coupled to the drive and positioned within a cylindrical tube in the wellbore, wherein the rod string has an induced tension load;

at least one centralizer threadably coupled in line with the rod string, wherein the at least one centralizer is configured to centralize the rod string within the cylindrical tube, wherein the at least one centralizer comprises flexure springs that are each fixedly attached to and extend between a first end portion and a second end portion of a cylindrical housing, wherein the flexure springs are compressible toward a middle portion of the cylindrical housing that is between the first end portion and the second end portion, wherein each of the flexure springs comprises a wide section positioned between a first narrow section and a second narrow section, wherein the wide section is thicker than the first narrow section and the second narrow section, and wherein the rod string rotates at a speed of at least 200 rpm within the cylindrical tube in the wellbore using the rotational force generated by the motor and the drive; and a downhole impeller-style pump coupled to a lowermost section of the rod string, wherein the downhole impeller-style pump is configured to operate using rotation of the rod string.

2. The system of claim 1, wherein the drive is a direct drive, and wherein an upper section of the rod string is rotated at a speed up to a value substantially equal to 4200 rpm.

3. The system of claim 1, wherein the drive is a geared centrifugal head drive, wherein the system further comprises a geared drive transmission positioned downhole at a position between the upper section and lowermost section of the rod string, wherein the geared drive transmission steps up a drive-rod string rotation speed measured at the ground surface from below 1800 rpm to a range between a first value substantially equal to 1800 rpm and a second value substantially equal to 4200 rpm.

4. The system of claim 1, further comprising a variable speed drive, wherein the variable speed drive controls an input angular velocity of the rod string.

5. The system of claim 1, wherein the flexure springs of the centralizer are leaf springs.

6. The system of claim 5, where the leaf springs comprise one or more roller wheels.

7. The system of claim 1, comprising three flexure springs spaced 120 degrees apart.

8. The system of claim 1, further comprising a roller, a thrust bearing, or both.

9. The system of claim 8, wherein the bearing includes a material selected from the group consisting of: graphite, ceramic, polycrystalline diamond, tungsten carbide, and magnetic materials.

10. The system of claim 1, wherein the flexure springs are selected from the group consisting of coil, compression, extension, and torsional spring configurations.

11. The system of claim 1, further comprising a cooling system for dissipating heat from the drive.

12. The system of claim 1, wherein a rod string tensioner induces the tension load.

13. The system of claim 12, wherein the rod string tensioner is a pressurized hydraulic system comprising a piston assembly.

14. The system of claim 13, wherein the pressurized hydraulic system comprises a vented upper portion and a pressurized lower portion, and wherein a resultant tension load is vertically loaded upward.

15. A method of operating an artificial lift system for wellbore applications, comprising:

a variable speed device relaying a command to a drive and motor assembly, wherein the drive is selected from a group consisting of geared centrifugal head drives and direct head drives, wherein the drive and motor assembly is positioned above a ground surface of a wellbore;

the drive and motor assembly operating a rod string tensioner to induce a tension load on the rod string;

the drive and motor assembly rotating the rod string positioned within a cylindrical tube in the wellbore at a first target speed of at least 200 rpm;

at least one centralizer threadably coupled in line with the rod string, wherein the at least one centralizer is configured to centralize the rod string within the cylindrical tube, wherein the at least one centralizer comprises flexure springs that are each fixedly attached to and extend between a first end portion and a second end portion of a cylindrical housing, wherein the flexure springs are compressible toward a middle portion of the cylindrical housing that is between the first end portion and the second end portion, wherein each of the flexure springs comprises a wide section positioned between a first narrow section and a second narrow section, wherein the wide section is thicker than the first narrow section and the second narrow section, and wherein the rod string rotates at the first target speed within the cylindrical tube in the wellbore using a rotational force generated by the drive and the motor assembly; and the rotating rod string operating a downhole impeller-style pump coupled to a lowermost section of the rod string.

16. The method of claim 15, further comprising:

a downhole transmission rotating the rod string at a second target speed, wherein the second target speed is greater than the first target speed.

17. The method of claim 16, further comprising:

a cooling system dissipating heat from the downhole transmission.

18. The method of claim 15, further comprising:

a cooling system dissipating heat from the drive.

* * * * *